United States Patent [19]

Anderson et al.

[11] Patent Number: 4,988,611

[45] Date of Patent: Jan. 29, 1991

[54] IMAGING UTILIZING A LIGHT-HANDLEABLE PHOTOGRAPHIC ELEMENT HAVING SOLID PARTICLE DISPERSION FILTER DYE LAYER

[75] Inventors: Richard B. Anderson, Fairport; Ronda E. Factor, Rochester; Anthony Adin, Rochester; Donald R. Diehl, Rochester, all of N.Y.

[73] Assignee: Eastman Kodak Company, Rochester, N.Y.

[21] Appl. No.: 481,850

[22] Filed: Feb. 20, 1990

Related U.S. Application Data

[63] Continuation-in-part of Ser. No. 213,652, Jun. 30, 1988, abandoned.

[51] Int. Cl.[5] ..... G03C 1/00

[52] U.S. Cl. ..... 430/494; 430/510; 430/516; 430/522; 430/606

[58] Field of Search ..... 430/510, 516, 522, 494, 430/606

[56] References Cited

U.S. PATENT DOCUMENTS

| | | | |
|---|---|---|---|
| 3,406,069 | 10/1968 | Overman | 430/510 |
| 3,746,539 | 7/1973 | Ohmatsu et al. | 430/522 |
| 3,932,188 | 1/1976 | Tanaka et al. | 430/522 |
| 4,203,716 | 5/1980 | Chen | 430/510 |
| 4,294,916 | 10/1981 | Postle et al. | |
| 4,294,917 | 10/1981 | Postle et al. | |
| 4,440,852 | 4/1984 | Onishi et al. | 430/522 |
| 4,500,631 | 2/1985 | Sakamoto et al. | 430/522 |
| 4,716,099 | 12/1987 | Simons | 430/510 |
| 4,756,993 | 7/1989 | Kitatani et al. | 430/522 |
| 4,764,455 | 8/1989 | Arakawa et al. | 430/517 |
| 4,803,149 | 2/1989 | Takahashi et al. | 430/606 |

*Primary Examiner*—Jack P. Brammer

*Attorney, Agent, or Firm*—Paul L. Marshall

[57] ABSTRACT

A photographic element is disclosed for handling under a first radiation source and imagewise exposure to a second radiation source having a solid particle dispersion filter dye layer that absorbs radiation emitted to which the element is sensitive emitted by the first source.

14 Claims, No Drawings

IMAGING UTILIZING A LIGHT-HANDLEABLE PHOTOGRAPHIC ELEMENT HAVING SOLID PARTICLE DISPERSION FILTER DYE LAYER

This application is a continuation-in-part of application Ser. No. 213,652, filed June 30, 1988, now abandoned.

FIELD OF THE INVENTION

This invention relates in general to photography and specifically to an imaging process for photographic elements that can be handled under a radiation source without requiring packaging in a dark container.

BACKGROUND OF THE INVENTION

Photographic elements exhibit sensitivity to a wide variety of light and radiation wavelengths. Elements based on silver halides, for example have a natural or intrinsic sensitivity to blue light. Silver halide can also be sensitive to other wavelengths, ranging from X rays, ultraviolet, various portions of the visible spectrum, and infrared radiation. This can be accomplished through various known means, such as varying the halide content (e.g., silver chloride is primarily sensitive to ultraviolet radiation) or through the use of various spectral sensitizing dyes. Because most silver halide is naturally sensitive to blue light, and because of sensitivity imparted to silver halide through chemical sensitization, spectral sensitization, or both, photographic elements must usually be handled in the dark from the time they are prepared until after they are exposed and processed.

The requirement for dark handling can be satisfied in a number of ways, such as darkroom handling, packaging the element in a light-sealed cassette or other container, and safelight handling, where the wavelength of the safelight is selected so as to not overlap with the sensitivity of the element. These techniques have proven very useful over time, but they are subject to disadvantages. Darkroom handling is cumbersome, time-consuming, expensive, and subject to exposure of the element if the darkroom is dark conditions of the room are compromised. Cassettes and containers are expensive, difficult to prepare, require a mechanism for allowing the element to be exposed at the right time and place, and are subject to failure if not properly sealed to light. Safelights can also be useful, but their feasibility depends on a photographic element having little or no spectral sensitivity in the range of light emitted by the safelight. Since many sensitizing dyes sensitize silver halide in regions of the spectrum in addition to that for which they are intended, the feasibility of using safelights is often quite limited. Also, safelights must be used in conjunction with a darkroom to be effective.

In an effort to avoid the above problems, and to provide photographic materials handleable in white light or room light, several specialized materials have incorporated filter dye layers above the radiation sensitive layers. Such dyes must effectively absorb radiation that would otherwise reach the radiation sensitive layer from the time the element is prepared until it is exposed and processed. The dye must also be decolorized and/or removed from the element during processing, so as to not adversely effect image quality or cause dye stain. For example, U.S. Pat. No. 3,705,807 describes a radiographic material that is handleable under yellow safelights having a protective layer comprising a yellow absorbing filter dye. U.S. Pat. No. 4,232,116 describes an ultraviolet-sensitive photographic film that comprises a yellow filter layer over a silver halide emulsion layer of at least 50 mole % silver chloride.

The use of filter dye layers over radiation sensitive layers to impart white light or safelight handleability to photographic elements has been limited to relatively specialized situations for a number of reasons. One problem has been that many potential water soluble filter dyes tend to wander throughout the photographic material, causing a number of adverse effects, such as desensitization, fogging, stain, and others. Water insoluble filter dyes are much less susceptible to wandering, are usually not decolorized or removed during photographic processing. One solution to this dilemma has been to coat soluble filter dyes along with a polymeric mordant to reduce dye wandering. This approach, however, has only limited effectiveness as mordants tend to either bind the dye too strongly, resulting in incomplete dye removal and dye stain, or too weakly, resulting in dye wandering and its associated adverse effects. Furthermore, at the levels of dye concentration often required for white light or safelight protection, these problems are often aggravated.

It is known in the art to use filter dyes for other purposes. Lemahieu et al describe in U.S. Pat. No. 4,092,168 a combination of specific monomethine oxonol and pentamethine oxonol dyes useful as antihalation dyes. The dyes are insoluble at coating pH's, thus eliminating the need for a dye mordant, and are soluble for removal and/or decolorization at processing pH's. These dyes are disclosed as being dispersible as solid particles in aqueous hydrophilic colloid compositions; however, no suggestion is given that any other dyes might possess the same beneficial solubility properties. The reference discusses the absorbance properties of the dyes and their suitability for antihalation use, but no teaching whatsoever is presented that the dyes might be useful at the levels required for white light or safelight protection nor is there any teaching as to what other dyes might possess the beneficial solubility properties of being aqueous insoluble at coating pH's and highly aqueous soluble at processing pH's. There is also no teaching that would enable anyone as to how to choose dyes other than those specifically disclosed in the U.S. Pat. No. 4,092,168 to obtain those properties.

SUMMARY OF THE INVENTION

It has now been discovered that adequate white light or safelight protection can be provided and many of the foregoing problems avoided by protecting the radiation sensitive layer of a photographic element to unwanted exposure during handling with a layer comprising a solid particle dispersion of a filter dye having the formula:

$$[D-(A)_y]-X_n \qquad (I)$$

where

D is a chromophoric radiation-absorbing moiety, said moiety comprising an aromatic ring when y is 0, A is an aromatic ring bonded directly or indirectly to D, X is a substituent, either on A or on an aromatic ring portion of D, with an ionizable proton having a pKa of 4 to 11 in a 50/50 mixture on a volume basis of ethanol and water, y is 0 to 4, and n is 1 to 7, said dye, when in nonionized form, having a log partition coefficient of from 0 to 6.

Specifically excluded from dye dispersions useful in the invention are the dispersions of prior art dyes and obvious variations thereof known to be used as solid particle dispersions. These dyes comprise those according to U.S. Pat. No. 4,092,168, which have the formula:

(II)

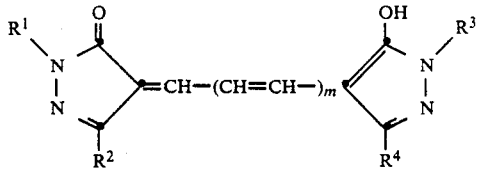

where $R^1$ and $R^3$ each independently represents an alkyl group or an aryl group, $R^2$ and $R^4$ each independently represents an alkyl group, an aryl group, or COOR where R is alkyl or aryl, m is 0 or a positive integer, and the molecule contains at least two carboxyl groups in their free acid form and further contains no solubilizing groups.

Although U.S. Pat. No. 4,092,168 discloses specific dyes having the above described beneficial solubility properties, it and the rest of the prior art does not provide any disclosure that would enable one skilled in the art to determine other dyes that would have the same beneficial properties. Moreover, U.S. Pat. No. 4,092,168 does not disclose trimethine pyrazolone oxonols, which have been found to offer unexpected sharp cutting absorbance peaks in solid particle dispersion form, rendering them highly useful for providing selective safelight and white light handleability for a variety of spectrally sensitized photographic emulsions.

The present invention provides the enabling disclosure not found in the prior art. It has now been found that dyes of formula (I) will be substantially insoluble at pH's of 6 or below and substantially soluble at pH's of 8 or above when X has a pKa in a 50/50 mixture (volume basis) of ethanol and water of from 4 to 11 and when the nonionized (neutral) dye has a log partition coefficient (log P) of from 0 to 6.

Such an element is intended for handling under a first radiation source and imagewise exposure to a second radiation source. The element comprises a support having thereon a radiation sensitive layer that is sensitive to at least a portion of the region of the spectrum of radiation emitted by the first radiation source and a portion of the region of the spectrum of radiation emitted by the second radiation source. According to the invention, between the first radiation source and the radiation-sensitive layer, the element has a layer comprising a vehicle and at least one solid particle dispersion filter dye as described above that absorbs in the wavelength region emitted by the first source and to which the radiation sensitive layer is sensitive. The dye is present in an amount sufficient to prevent formation in the radiation-sensitive layer of a developable latent image from exposure to the first radiation source.

The elements used in the practice of the invention utilizing the above-described solid particle dispersion filter dyes provide effective white light or safelight protection, do not suffer from dye wandering, and the filter dyes are removed and/or decolorized during photographic processing. Prior art technology generally required the use of a mordant to immobilize filter dyes in order to prevent dye wandering. However, when the large amounts of dyes needed to provide white light or safelight handleability are incorporated in photographic elements, the use of mordants can be impractical because of problems such as increased layer thickness, increased cost, increased chemical loading, and potential retained dye stain. The elements useful in the practice of the invention allow for the use of filter dyes to provide white light or safelight protection in a number of situations or with sensitizing dyes having broad sensitization spectra, e.g., white light handleable infrared sensitive elements, green safelight handleable red sensitive elements, or red or yellow safelight handleable blue-sensitive elements, where they have not been used before.

DESCRIPTION OF THE PREFERRED EMBODIMENTS

The chromophoric radiation absorbing moiety, D, of formula (I) can be any of a number of well known chromophores. These include cyanines, merocyanines, oxonols, arylidenes (i.e., merostyryls), anthraquinones, triphenylmethanes, azo dye types, azomethines, and others. The specific chromophore used is not critical, as long as all the criteria of formula (I) are met. These dyes are commonly used in the photographic art, and are more fully described in James, *The Theory of the Photographic Process,* 4th, Macmillan, New York (1977) and Hamer, *The Cyanine Dyes and Related Compounds,* Interscience (1964).

The cyanine dyes include, joined by a methine linkage, two basic heterocyclic nuclei, such as those derived from quinolinium, pyridinium, isoquinolinium, 3H-indolium, benzindolium, oxazolium, thiazolium, selenazolinium, imidazolium, benzoxazolinium, benzothiazolium, benzoselenazolium, benzimidazolium, naphthoxazolium, naphthothiazolium, naphthoselenazolium, thiazolinium dihydronaphthothiazolium, pyrylium, and imidazopyrazinium quaternary salts.

The merocyanine dyes include, joined by a methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3 -dione, cyclohexan-1,3 -dione, 1,3-dioxan-4,6-dione, pyrazolin-3,5-dione, pentan-2,4-dione, alkylsulfonyl acetonitrile, malononitrile, isoquinolin-4-one, and chroman-2,4 -dione.

The oxonol dyes include, joined by a methine or bridged methine linkage, two acidic carbo- or heterocyclic nuclei, such as those described above for merocyanine dyes, with the exclusion of 2 -pyrazolin-5 -one.

The arylidene dyes include, joined by a methine or bridged methine linkage, an acidic nucleus as described previously and an aryl group, substituted with electron-donating substituents, such as alkyl- or dialkylamino, methoxy, and the like.

The anthraquinone dyes include those compounds derived from the anthraquinone nucleus and substituted with electron donating or electron withdrawing groups so as to extend the chromophoric nature of the compound.

The triphenylmethane dyes include those compounds with three aryl groups joined to a single methine linkage and substituted with suitable electron-donating or electron-withdrawing substituents so as to produce an extended chromophoric system.

The azo dyes include any of a large class of compounds with two nitrogens in the linkage between multiply-substituted aryl groups, as is known in the art.

The azomethine dyes include, joined by a single nitrogen in the unsaturated linkage, an acidic nucleus as described previously for the merocyanine dyes, and an aryl group substituted with electron donating substituents such as alkyl- or dialkylamino, methoxy, and the like.

All the above-described chromophoric radiation-absorbing compounds are well-known in the art. Additional examples of these and other dye classes suitable for use in this invention are disclosed in the *Colour Index 3d,* The Society of Dyers and Colourists, Great Britain (1971).

The aromatic ring (A or an aromatic ring, to which X is attached, that is part of D) of formula (I) can be any aromatic ring capable of bonding with D and X in a manner such that the proper pKa and log P are achieved. Examples of such rings include phenyl, naphthyl, anthracenyl, pyridyl, acenaphthyl, dihydronaphthyl, and pyrimidyl. The aromatic ring A, if present, may be bonded directly to D or indirectly (i.e., through a divalent linking group, such as alkyl, as is known in the art) to D.

The substituent, X, of formula (I) having an ionizable proton with a pKa in a 50/50 mixture (volume basis) of ethanol and water of from 4 to 11, when attached to the aromatic ring of formula (I), can be easily chosen by one skilled in the art. Especially preferred substituents are carboxyl and sulfonamido (especially $NHSO_2R$ where R is a substituted or unsubstituted alkyl group of from 1 to 6 carbon atoms).

The above identified U.S. Pat. No. 4,092,168 (and the rest of the art) do not describe solid particle dispersion filter dyes where X is anything other than carboxy. Thus, in one preferred embodiment, X is a substituent, other than carboxy, having an ionizable proton with a pKa in a 50/50 mixture (volume basis) of ethanol and water of from 4 to 11. Examples of A–X that do not utilize carboxy as the X group include sulfonamidophenyl (e.g., Ph—$NHSO_2R$ where Ph is a phenyl ring),

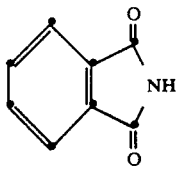

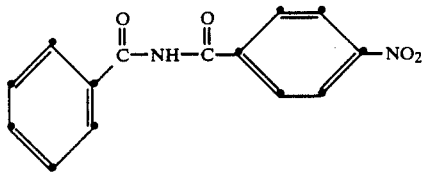

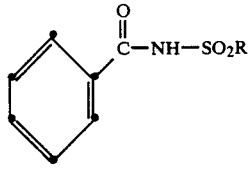

-continued

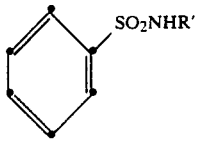

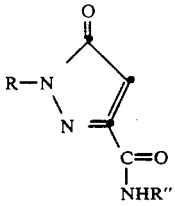

where R is alkyl (e.g., of about 1 to 6 carbon atoms) or aryl (e.g., phenyl), R′ is acyl (e.g., —CO—R), phenyl, or vinyl, and R″ is —CO—Ph or $SO_2R$. In another preferred embodiment, X has a pKa of from 7 to 11. Examples of A–X where X has a pKa of 7 to 11 include sulfonamidophenyl (e.g., Ph—$NHSO_2R$ where Ph is a phenyl ring),

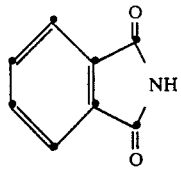

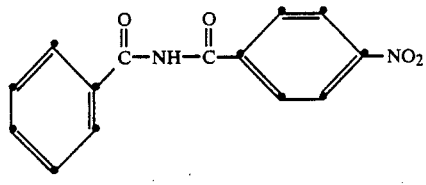

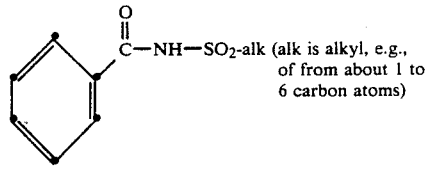

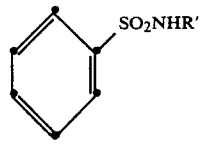

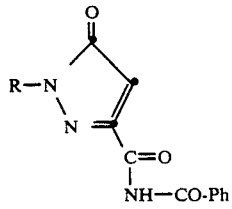

Sulfonamido is an specially preferred X substituent (especially $NHSO_2R$ where R is a substituted or unsubstituted alkyl group of from 1 to 6 carbon atoms).

The pKa parameter is a well-known measurement of the dissociation constant of an ionizable compound in aqueous environments. It is discussed in most basic chemistry texts and does not require further explanation here. The log partition coefficient (log P) of the unionized (i.e., neutral) compounds of formula (I) is preferably from 0 to 6. The log P parameter is a well known measurement of the solubility of a compound in aqueous liquids compared to its solubility in nonpolar organic solvents. The log P parameter is further described, along with log P data for organic compounds, in C. Hansch & T. Fujita, J. Am. Chem. Soc., 86, 1616–25 (1964) and A. Leo & C. Hansch. *Substituent Constants for Correlation analysis in Chemistry and Biology,* Wiley, New York (1979).

Examples of dyes useful in the practice of the invention and methods of preparation are disclosed in U.S. patent application Ser. No. 137,495, filed Dec. 23, 1987, now abandoned in favor of continuation in part application Ser. No. 373,749, filed June 30, 1989, the disclosures of which are incorporated herein by reference.

The radiation sensitive layer of the element useful in the practice of the invention is sensitive to at least a portion of the region of the spectrum of radiation emitted by the first radiation source and a portion of the region of the spectrum of radiation emitted by the second radiation source. In most situations, these will be different regions of the spectrum, although it is contemplated that the practice of the invention would include elements where the two regions overlap to some extent. In such a situation, the second radiation source is preferably of a higher intensity than the first radiation source. The intensity of the two radiation sources, the sensitivity of the radiation sensitive layer, and the amount of dye would be balanced so that the dye would absorb enough radiation to prevent latent image formation caused by the first radiation source but allow latent image formation by the second more intense radiation source to be used for imagewise exposure. Such a balancing is within the skill of the art.

There are a number of elements according to the invention that provide that can be used to provide photographic elements having spectral sensitivities for which white light or safelight handleability has not been practical before the present invention. One such element is an infrared-sensitive element that is handleable under a first source such as daylight or room light that emits some radiation between 350 and 700 nm, yet can be imagewise exposed by a second radiation source that is an infrared radiation source, such as an infrared laser. Such lasers are known in the art and generally utilize diodes that emit somewhere in the region of from about 700 to 900 nm. One common emission wavelength is about 800 nm and other typical emission wavelengths are about 750, 780, 820, and 870 nm. A preferred infrared sensitive element useful in accordance with the invention has a radiation-sensitive layer that is sensitive to some radiation between 350 and 900 nm.

These wavelength ranges, as well as ranges described below for other embodiments of the invention are intended to be inclusive, not limiting. In other words, when it is stated that the first source emits some radiation between 350 and 700 nm, it need not emit radiation across the entire range of 350 to 700 nm; rather, it need only emit radiation at some point(s) or region(s) within that range. Similarly, the second source need not emit radiation across the entire range of 700 to 900 nm. It only needs to emit radiation at some point(s) or region(s) within that range. The radiation-sensitive layer need not be sensitive to all radiation within the 350 to 900 nm range. It only needs to be sensitive to some point(s) or region(s) within that range, subject to the basic requirement of the invention that it is sensitive to at least some portion of the radiation emitted by the first source and sensitive to some portion of the radiation emitted by the second source. The various elements, sources, and dyes used in accordance with the invention may also have sensitivity, emit, or absorb in regions outside the specified ranges as long as they also have sensitivity, emit, or absorb at some point(s) or region(s) within the specified range so as to fall within the scope of the invention.

In a preferred embodiment, the filter dye absorbs radiation at some point(s) or region(s) in the 350 to 700 nm range, subject to the basic requirement of the invention that it absorb in the wavelength region emitted by the first source and to which the radiation sensitive layer is sensitive. Such a filter dye preferably comprises a solid particle dispersion of a dye according to the formula (III):

$$D_1—L_1=A_1$$

and a solid particle dispersion of a dye according to the formula (IV):

$$D_2—L_2=L_3—L_4=A_2$$

wherein $D_1$—and $D_2$—are each independently selected from the group consisting of:

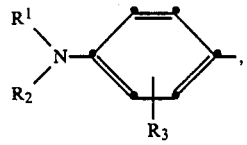

$A_3$-(-$L_5$=$L_6$-)$_p$, and

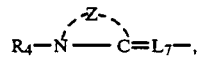

$A_1$, $A_2$, and $A_3$ are each independently a ketomethylene residue, $R_1$ and $R_2$ are each independently substituted or unsubstituted alkyl or substituted or unsubstituted aryl, or may represent the carbon atoms necessary to form a fused ring with the phenyl ring to which the N atom is attached, $R_3$ is hydrogen, substituted or unsubstituted alkyl, or substituted or unsubstituted aryl, $R_4$ is substituted or unsubstituted alkyl, $R_5$ is substituted or unsubstituted alkyl or substituted or unsubstituted aryl, Z represents the atoms necessary to complete a substituted or unsubstituted 5- or 6-membered heterocyclic nucleus, $L_1$, $L_2$, $L_3$, $L_4$, $L_5$, $L_6$, and $L_7$ are each independently a substituted or unsubstituted methine group, at least one of $A_1$, $A_2$, $A_3$, Z, and $R_4$ in the compound of formula (III) is substituted with —$X_1$ and at least one of $A_1$, $A_2$, $A_3$, Z and $R_4$ in the compound of formula (IV) is substituted with —$X_2$, and p is 0 or 1.

According to formulas (III) and (IV), A1, A2, and A3 are each independently a ketomethylene nucleus. This class of chemical groups is well-known in the art as described, for example, in the above-referenced Hamer, The Cyanine Dyes and Related Compounds, pp. 469–494, 595–604 (1964). Examples of preferred keto-methylene residues include benzoyl acetonitrile, 2-pyrazolin-5 -one, pyrazolindione, a barbituric acid nucleus, rhodanine, indanedione, isoxazolinone, benzofuranone, chromandione, cyclohexanedione, dioxanedione, furanone, isoxazolidindione, pyrandione, and pyrrolinone.

R1 and R2 are each independently substituted or unsubstituted alkyl, preferably of from 1 to 6 carbon atoms, or substituted or unsubstituted aryl, Preferably from 6 to 14 carbon atoms. R1 and R2 may also represent the carbon atoms necessary to form a fused ring with the phenyl ring to which the N atom is attached, for example, in a dye having the formula:

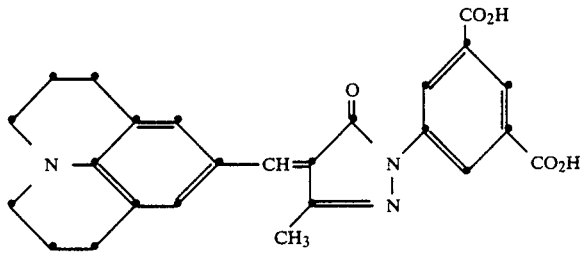

$R_3$ is hydrogen, substituted or unsubstituted alkyl, preferably from 1 to 6 carbon atoms, or substituted or unsubstituted aryl, preferably from 6 to 14 carbon atoms. Examples of $R_3$ include methyl, ethyl, propyl, butyl, isopropyl, t-butyl, tolyl, and phenyl.

$R_4$ is substituted or unsubstituted alkyl, preferably of from 1 to 15 carbon atoms. Examples of $R_4$ include ethyl, propyl. methoxyethyl, benzyl, 4-carboxybenzyl, and ethoxyethoxyethyl.

$R_5$ is substituted or unsubstituted alkyl, preferably of from 1 to 6 carbon atoms, or substituted or unsubstituted aryl, preferably of from 6 to 12 carbon atoms. Examples of $R_5$ include methyl, ethyl, propyl, hexyl, phenyl, and tolyl.

The R groups and the L groups described above may be substituted with any of a number of known substituents, as long as they do not adversely effect the solubility properties of the dye compound. The effect on dye solubility can be determined by one of ordinary skill in the art by determining the effect on the log P of the compound, which is preferably between 0 and 6. Useful substituents include halogen (e.g., chloro, fluoro), alkoxy (e.g., methoxy, ethoxy), amino (e.g., dimethylamino, diethylamino), alkylcarboxy (e.g., ethoxycarbonyl, isopropoxycarbonyl), and acyl (e.g., carbamoyl, acetyl).

Z represents the atoms necessary to complete a substituted or unsubstituted 5- or 6-membered heterocyclic nucleus. The heterocyclic nucleus is of the type commonly used in cyanine dyes, and is well-known in the art. They are described, for example, in the above incorporated James and Hamer references. Examples of such heterocyclic nuclei include thiazole, selenazole, oxazole, imidazole, indole, benzothiazole, benzoselenazole, benzoxazole, benzimidazole, benzindole, naphthothiazole, naphthoselenazole, naphthoxazole, and naphthimidazole. The nucleus may be substituted with known substituents, such as substituted or unsubstituted alkyl of from 1 to 10 carbon atoms (e.g., methyl, ethyl, 3-chloropropyl), alkoxy of from 1 to 8 carbon atoms (e.g., methoxy, ethoxy), halogen (e.g., chloro, fluoro), substituted or unsubstituted aryl of from 6 to 20 carbon atoms (e.g., phenyl), or with carbon atoms form a fused ring system (e.g., with a benzothiazole nucleus or a naphthothiazole nucleus).

Examples of dyes according to formula (III) include:

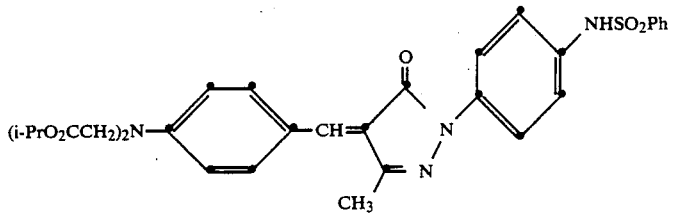

(1)

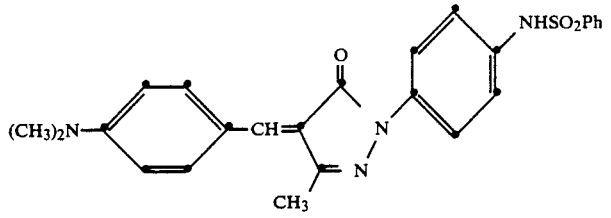

(2)

-continued
(3)
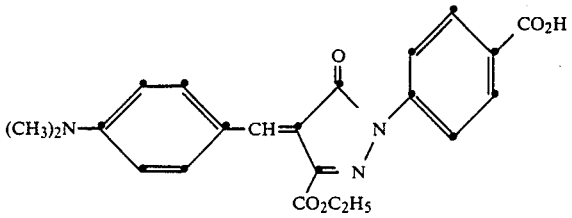
(4)
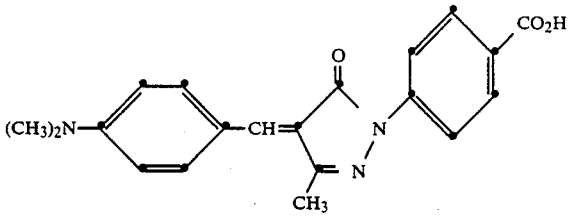
(5)
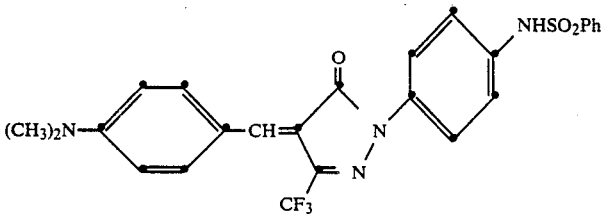
(6)
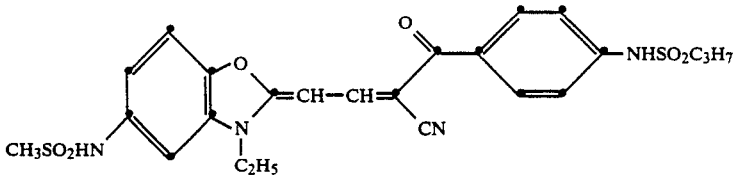
(7)
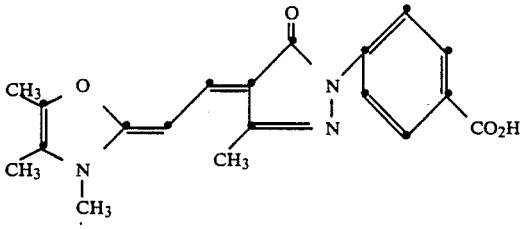
(8)
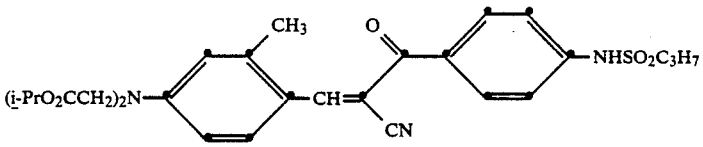
(9)
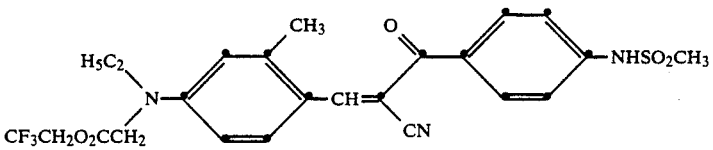
(10)
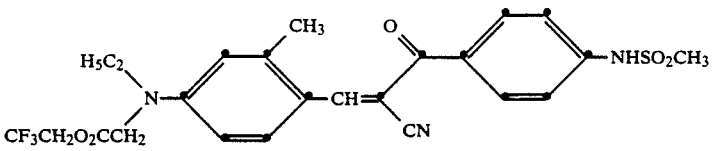

-continued
(11)
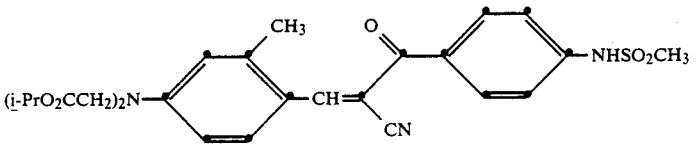
(12)
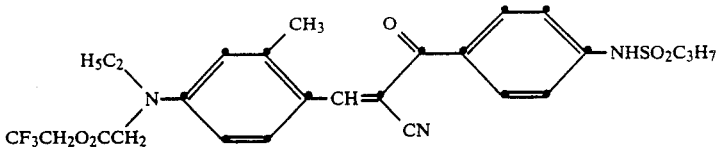
(13)
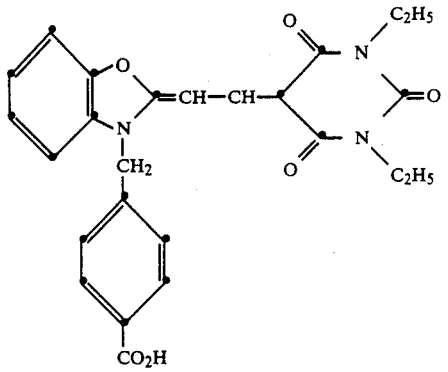
(14)
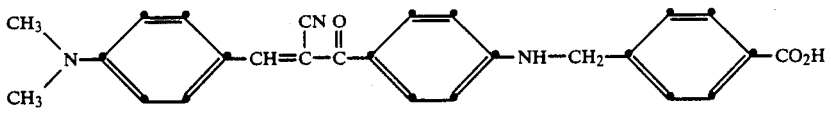
(15)
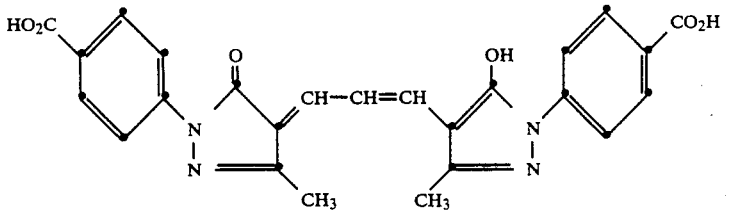
(16)
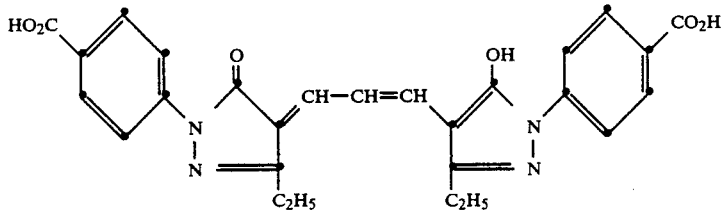
(17)
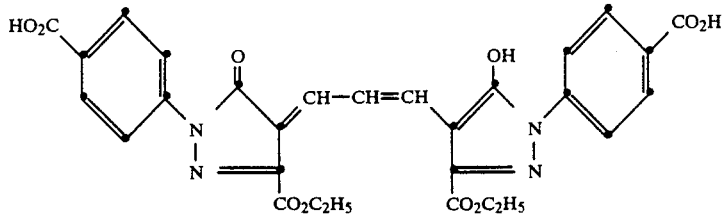
Examples of dyes according to formula (IV) include:

-continued (18)

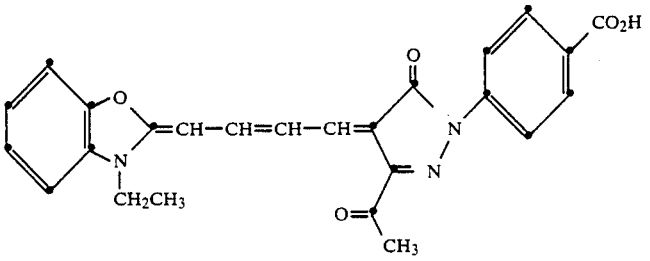

(19)

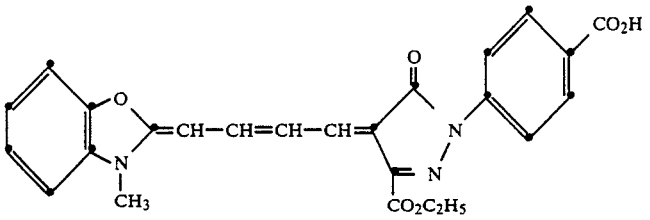

(20)

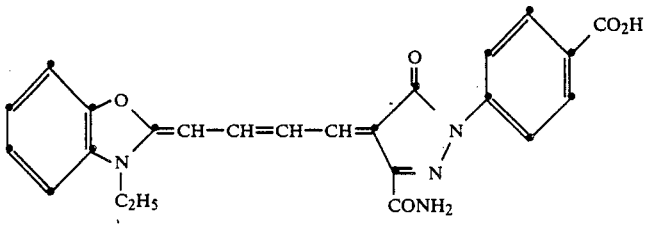

(21)

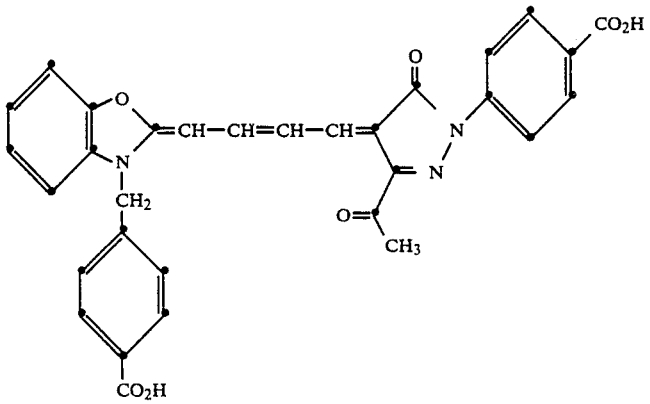

(22)

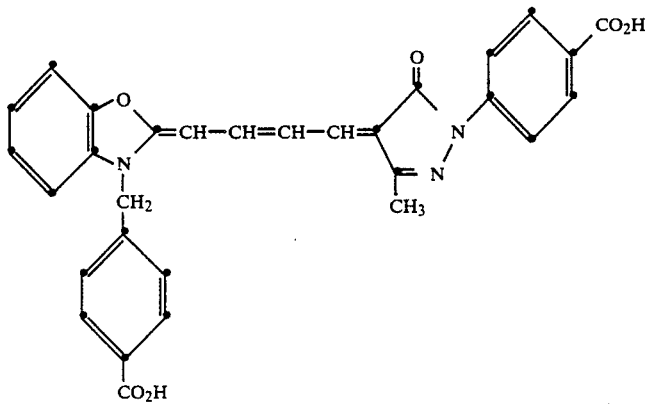

Another element useful in the practice of the invention is a blue light sensitive element that is handleable under a first source such as a red safelight that emits some radiation between 560 and 700 nm, yet can be imagewise exposed by a second radiation source that emits somewhere in the region of from about 400 to 520 nm. An example of such a second source is an argon ion laser, which emits at about 488 nm. The radiation sensitive layer of this element preferably is sensitive to some radiation from 350 and 700 nm.

In a preferred embodiment, the filter dye absorbs radiation at some point(s) or region(s) in the 540 to 700 nm range, subject to the basic requirement of the invention that it absorb in the wavelength region emitted by the first source and to which the radiation sensitive layer is sensitive. Such a filter dye preferably comprises a solid particle dispersion of a dye according to the formula (V):

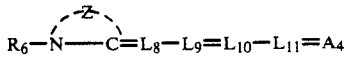

wherein $A_4$ is a ketomethylene residue, $L_8$, $L_9$, $L_{10}$, and $L_{11}$ are each independently a substituted or unsubstituted methine group, $R_6$ is substituted or unsubstituted alkyl, Z' represents the atoms necessary to complete a substituted or unsubstituted 5- or 6-membered heterocyclic nucleus, at least one of $A_4$, Z', and $R_6$ is substituted with $—X_4$, and $—X_4$ is $—CO_2H$ or $—NHSO_2R_7$, wherein $R_7$ is substituted or unsubstituted alkyl or substituted or unsubstituted aryl.

Examples of dyes according to formula (V) include:

(18)

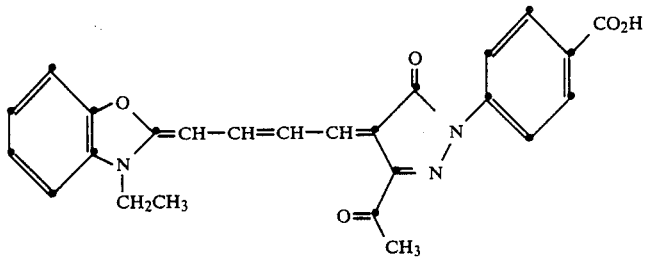

(19)

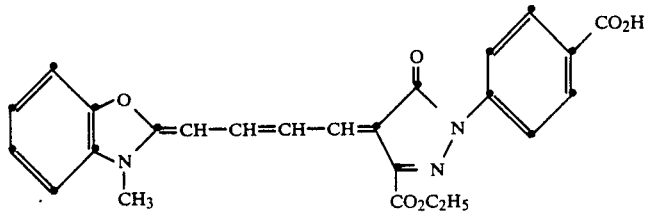

(20)

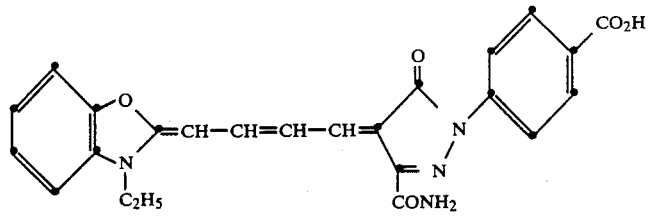

(21)

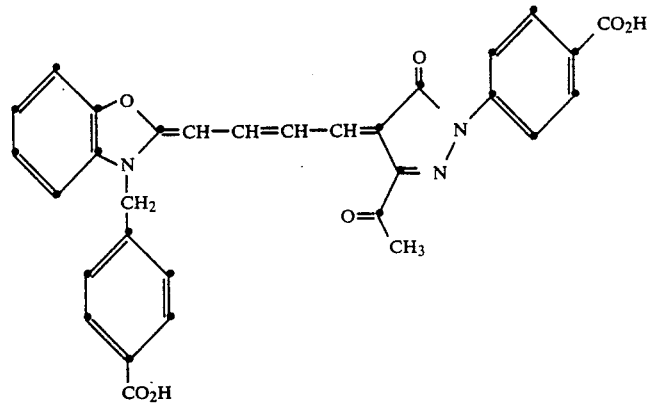

-continued
(22)
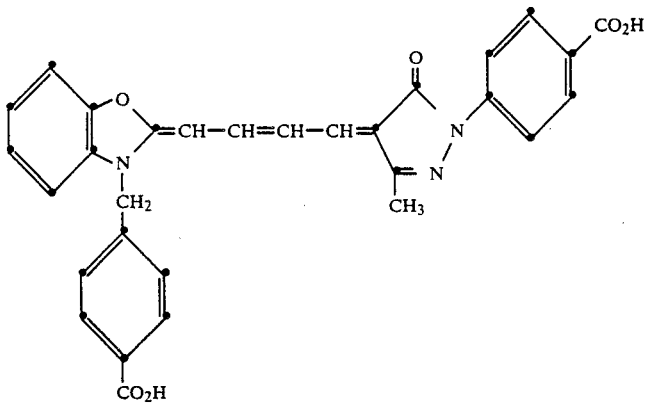
(28)
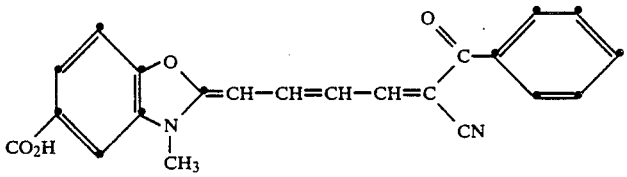
(29)
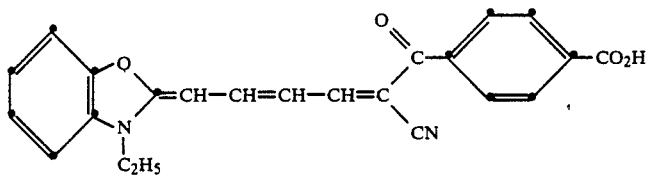
(30)
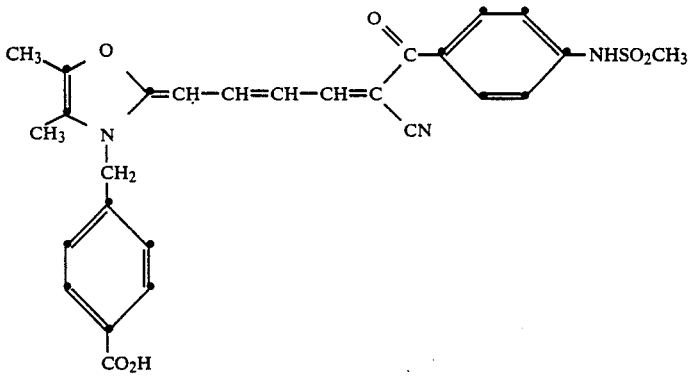
(31)
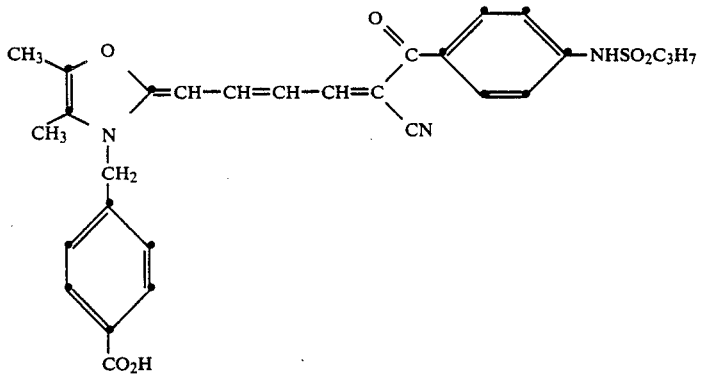

-continued (32)

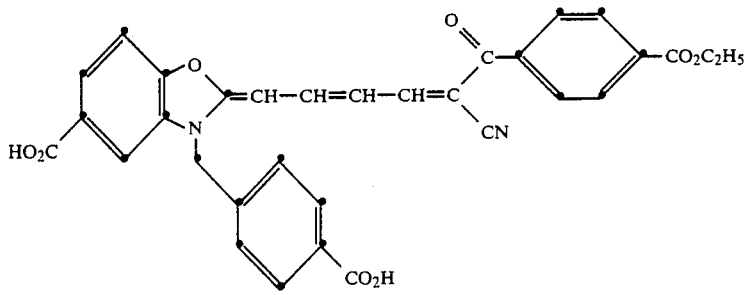

(33)

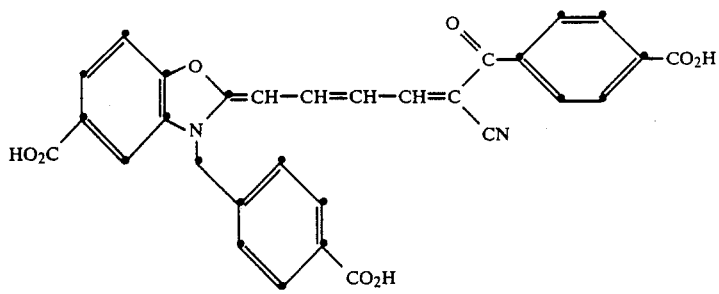

Another element useful in the practice of the invention is a blue light-sensitive element that is handleable under a first source such as a safelight that emits some radiation between 450 and 570 nm, yet can be image-wise exposed by a second radiation source, such as a helium neon laser, that emits somewhere in the region of from about 600 to 700 nm. The radiation sensitive layer of this element preferably is sensitive in the range of from about 350 and 700 nm.

In a preferred embodiment, the filter dye absorbs radiation at some point(s) or region(s) in the 450 to 590 nm range, subject to the basic requirement of the invention that it absorb in the wavelength region emitted by the first source and to which the radiation-sensitive layer is sensitive. Such a filter dye preferably comprises a solid particle dispersion of a dye according to the formula (VI):

$$A_6-L_{12}=L_{13}-L_{14}=A_6$$

or formula (VII):

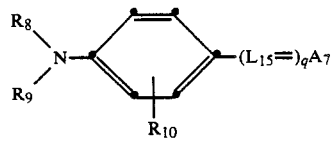

where $A_5$, $A_6$, and $A_7$ are as defined above for $A_1$, $A_2$, and $A_3$, $L_{12}$, $L_{13}$, $L_{14}$, and $L_{15}$ are as defined above for $L_1$–$L_7$, $R_8$, $R_9$, and $R_{10}$ are as defined above for $R_1$, $R_2$, and $R_3$, respectively, at least one of $A_5$, $A_6$ is substituted with $-X_5$ and at least one of $A_7$ and $R_9$ is substituted with $-X_7$, $-X_5$ and $-X_7$ are as defined above for $-X_1$, $-X_2$, and $-X_3$, and q is 1 or 3.

Examples of dyes according to formula (VI) include:

(15)

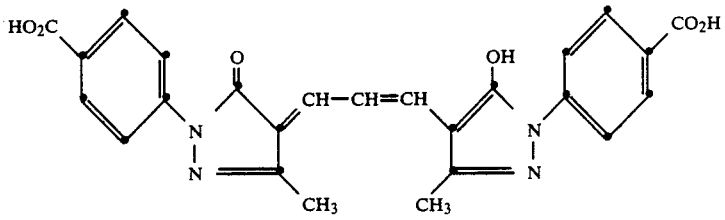

(16)

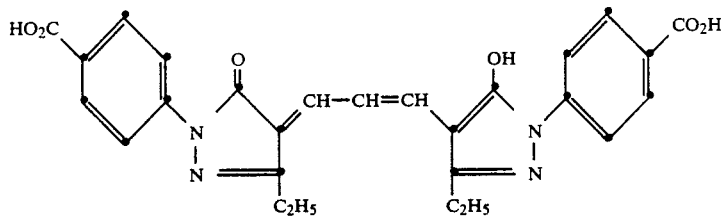

-continued
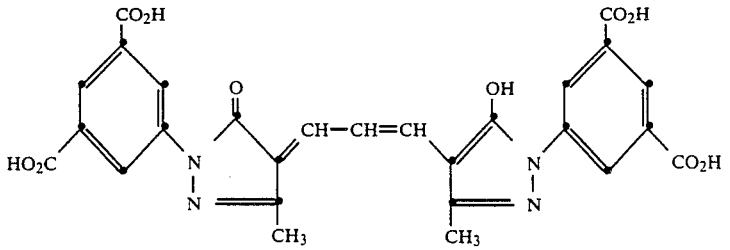
(34)
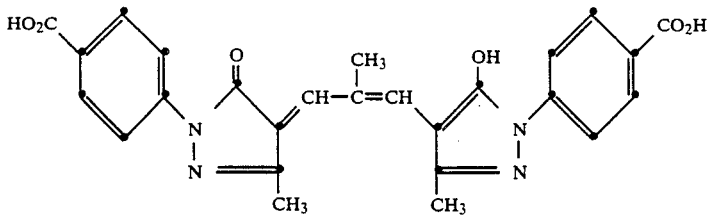
(35)
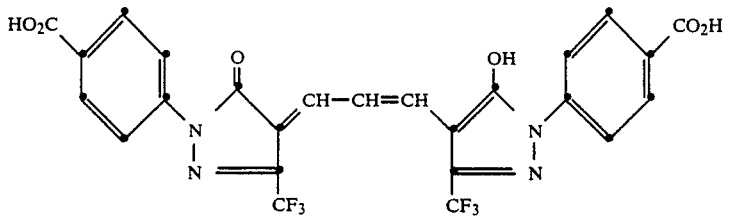
(36)
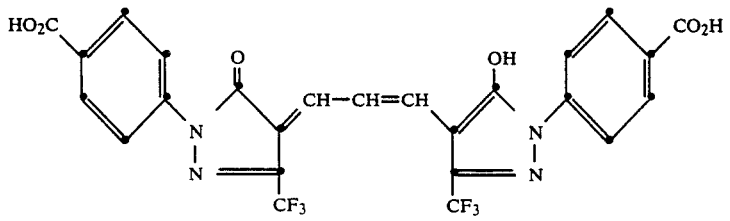
(37)
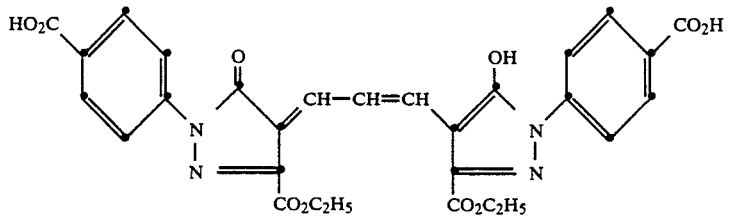
(17)
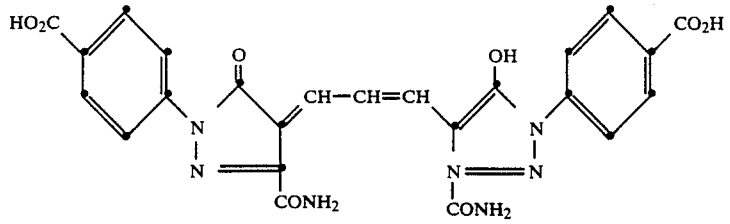
(39)

-continued
(40)
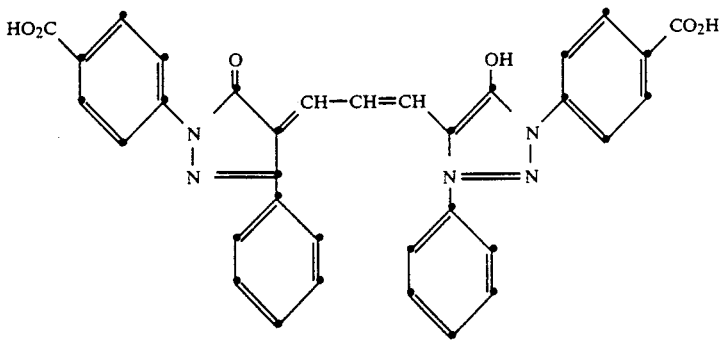
Examples of dyes according to formula (VII) include:
General Structure:
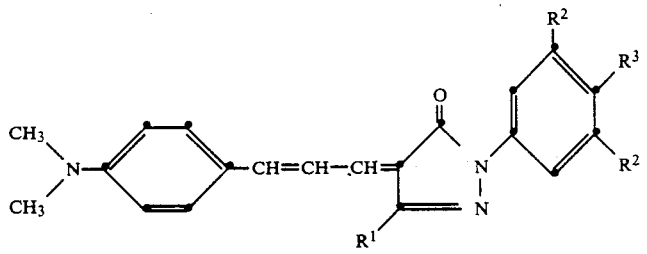
| Dye | $R^1$ | $R^2$ | $R^3$ | g-max | e-max ($\times 10^4$) (methanol) |
|---|---|---|---|---|---|
| 41 | $CH_3$ | H | $CO_2H$ | 516 | 4.62 |
| 42 | $CH_3CO$ | H | $CO_2H$ | 573 | 5.56 |
| 43 | $CO_2Et$ | H | $CO_2H$ | 576 | 5.76 |
| 44 | $CH_3$ | $CO_2H$ | H | 506 | 3.90 |
| 45 | $CO_2Et$ | $CO_2H$ | H | 560 | 5.25 |
(1)
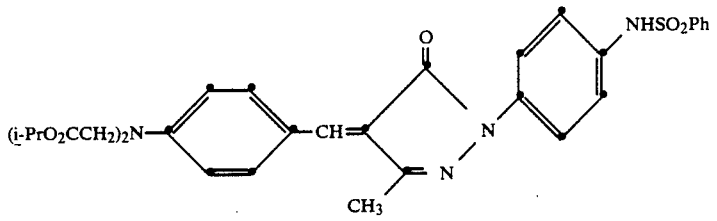
(47)
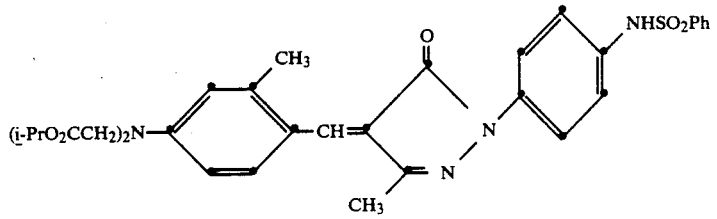
(48)
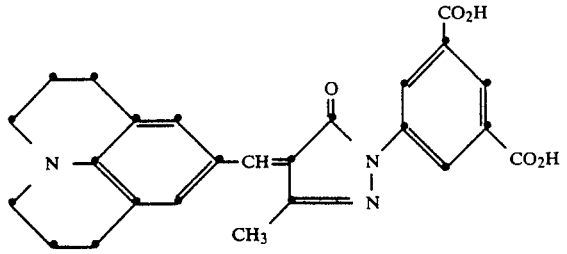

-continued (14)

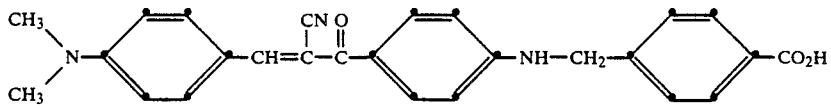

(50)

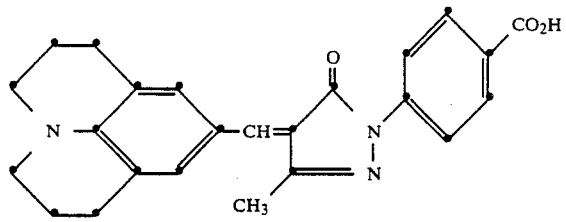

Another element useful in the practice of the invention is a photographic element that is sensitive to radiation from 350 to 600 nm and handleable under a first source such as a blue safelight that emits radiation between 400 and 510 nm, yet can be imagewise exposed by a second radiation source that emits in the region of from about 510 to 600 nm. The radiation sensitive layer of this element preferably is sensitive in the range of from 350 and 600 nm.

In a preferred embodiment, the filter dye absorbs radiation at some point(s) or region(s) in the 350 to 500 nm range, subJect to the basic requirement of the invention that it absorb in the wavelength region emitted by the first source and to which the radiation sensitive layer is sensitive. Such a filter dye preferably comprises a solid particle dispersion of a dye according to the formula (VIII):

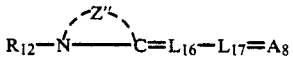

or a dye according to the formula (IX):

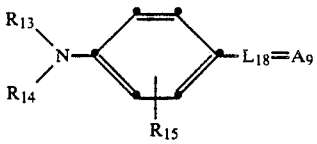

where $A_8$ and $A_9$ are as defined above for $A_1$, $A_2$, and $A_3$, $R_{11}$, $R_{12}$, $R_{13}$, and $R_{14}$ are as defined above for $R_4$, $R_1$, $R_2$, and $R_3$, respectively, $L_{13}$, $L_{14}$, and $L_{15}$ are as defined above for $L_1$-$L_7$, Z'' is as defined above for Z, at least one of $A_8$, Z'', and $R_{12}$ is substituted with $-X_8$ and at least one of $A_9$ and $R_{14}$ is substituted with $-X_9$, and $-X_8$ and $-X_9$ are as defined above for $-X_1$, $-X_2$, and $-X_3$.

Examples of dyes according to formula (VIII) include:

(53)

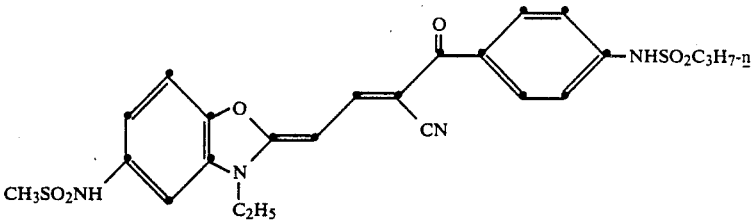

General Structure:

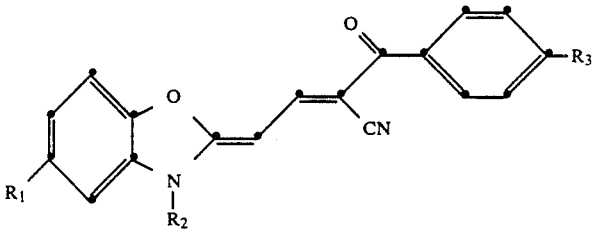

| Dye | $R^1$ | $R^2$ | $R^3$ |
|---|---|---|---|
| 54 | — | Et | $MeOEtSO_2NH$ |
| 55 | — | Me | $MeSO_2NH$ |
| 56 | $MeOEtSO_2NH$ | Et | $MeOEtSO_2NH$ |
| 57 | $MeOEtSO_2NH$ | Et | $HexSO_2NH$ |
| 58 | $MeSO_2NH$ | MeOEt | $MeSO_2NH$ |
| 59 | — | $CH_2PhCO_2H$ | $PrSO_2NH$ |

-continued

General Structure:

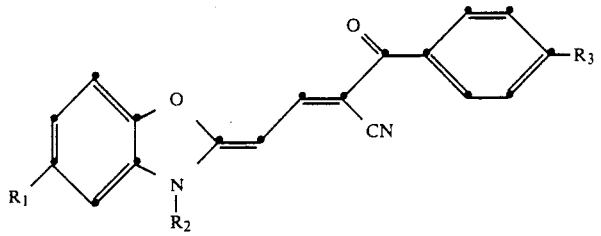

| | | | |
|---|---|---|---|
| 60 | $MeSO_2NH$ | MeOEt | $PrSO_2NH$ |
| 61 | $MeOEtSO_2NH$ | MeOEt | $PrSO_2NH$ |
| 62 | $EtSO_2NH$ | Et | $MeSO_2NH$ |
| 63 | $EtSO_2NH$ | Me | $MeSO_2NH$ |
| 64 | $MeOEtSO_2NH$ | MeOEt | $MeOEtSO_2NH$ |
| 65 | $HexSO_2NH$ | MeOEt | $MeSO_2NH$ |
| 66 | $MeOEtSO_2NH$ | MeOEt | $HexSO_2NH$ |
| 67 | — | $CH_2PhCO_2H$ | $MeSO_2NH$ |
| 68 | $MeSO_2NH$ | Me | $MeSO_2NH$ |
| 69 | $CO_2H$ | Me | $MeSO_2NH$ |
| 70 | $CO_2H$ | Me | $PrSO_2NH$ |
| 71 | $EtOEtOEtSO_2NH$ | Et | $MeSO_2NH$ |
| 72 | $EtOEtOEtSO_2NH$ | Et | $PrSO_2NH$ |
| 73 | $PrSO_2NH$ | Et | $MeSO_2NH$ |
| 74 | $PrSO_2NH$ | Me | $MeSO_2NH$ |
| 75 | $MeSO_2NH$ | Et | $EtSO_2NH$ |
| 76 | $EtSO_2NH$ | Et | $EtSO_2NH$ |
| 77 | $BuSO_2NH$ | Et | $MeSO_2NH$ |
| 78 | $BuSO_2NH$ | Et | $CO_2H$ |
| 79 | $BuSO_2NH$ | Me | $MeSO_2NH$ |
| 80 | $MeSO_2NH$ | Et | $BuSO_2NH$ |

(81)

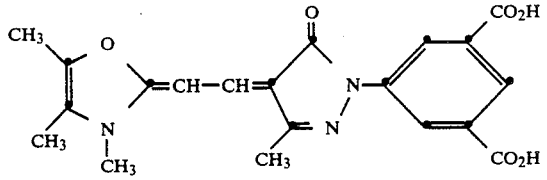

(82)

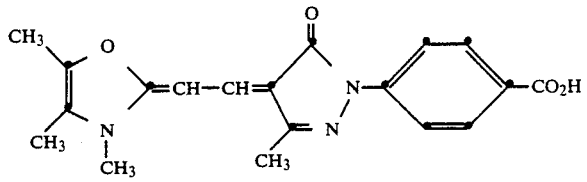

(83)

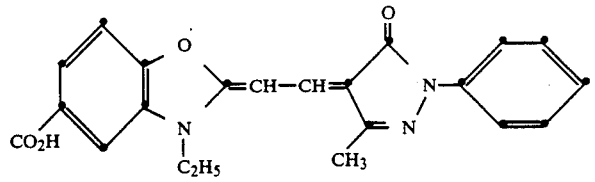

(84)

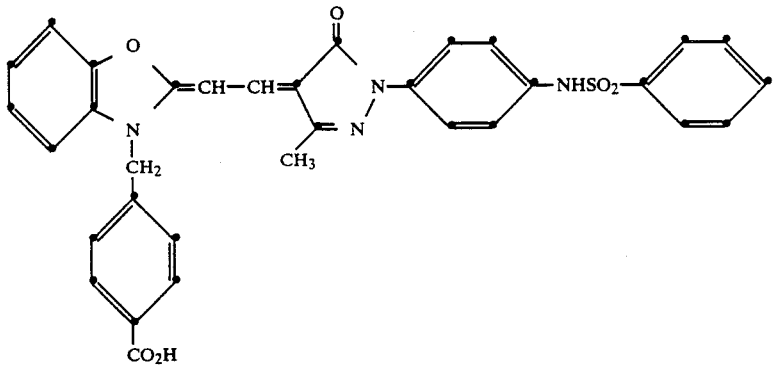

-continued
General Structure:
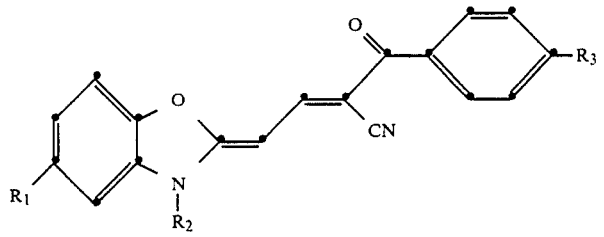
(85)
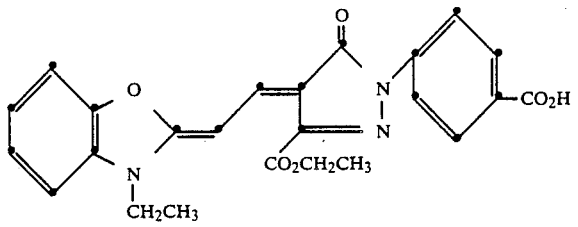
(86)
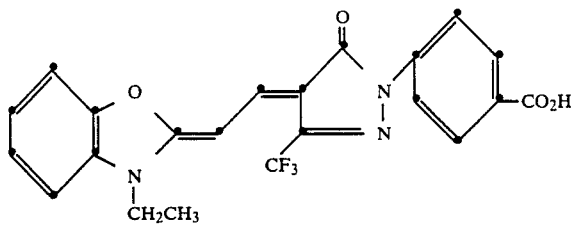
(87)
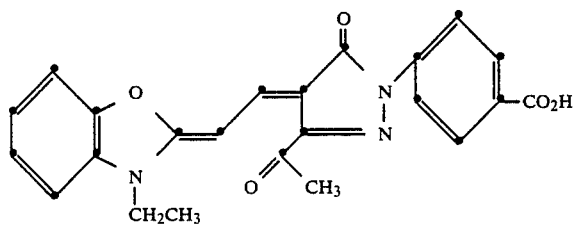
(88)
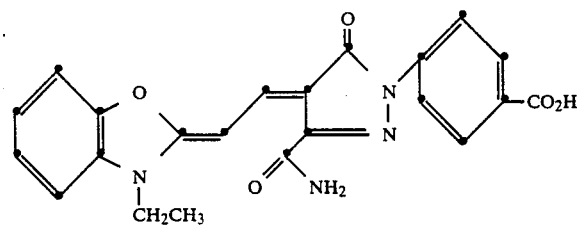
(89)
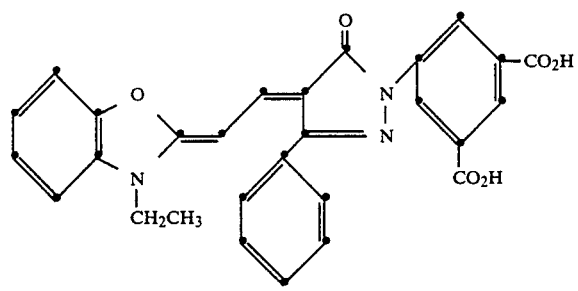

-continued
General Structure:
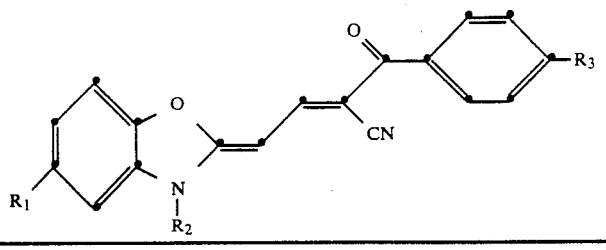
(90)
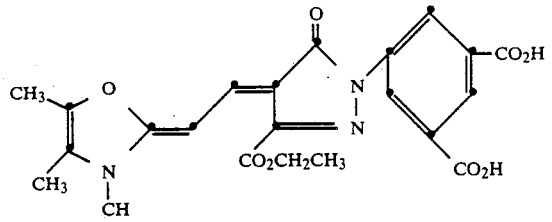
(91)
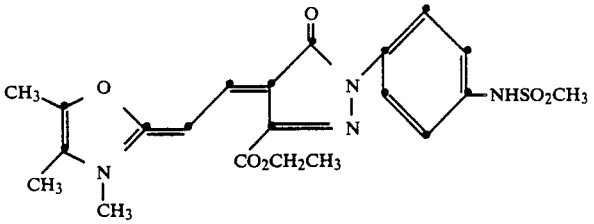
(92)
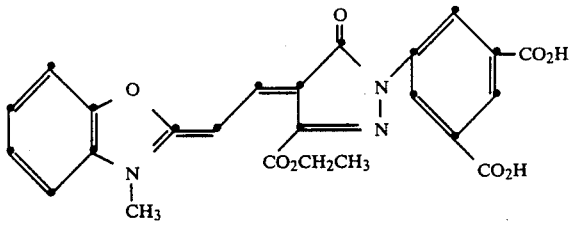
(93)
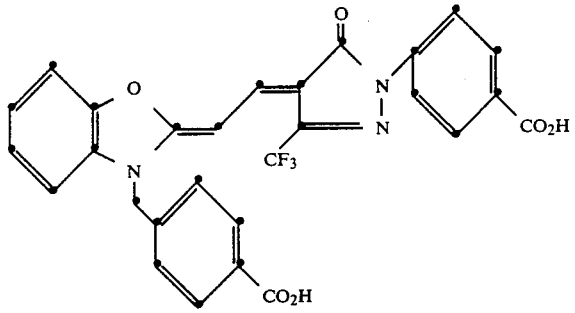

-continued
General Structure:
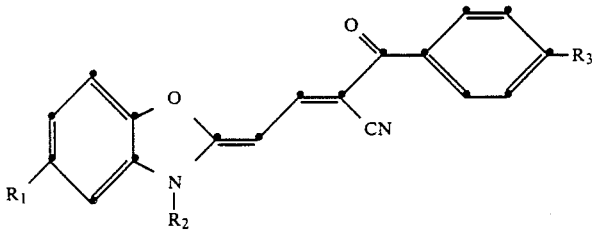
(94)
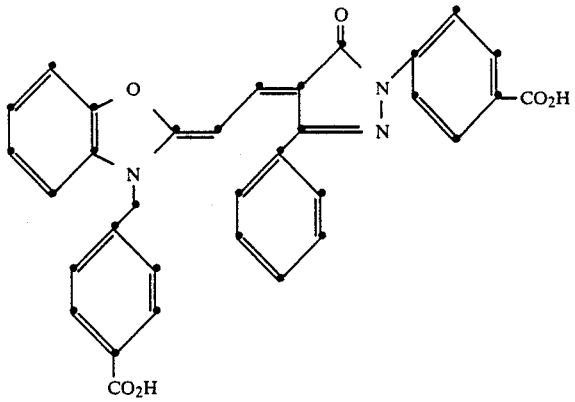
(95)
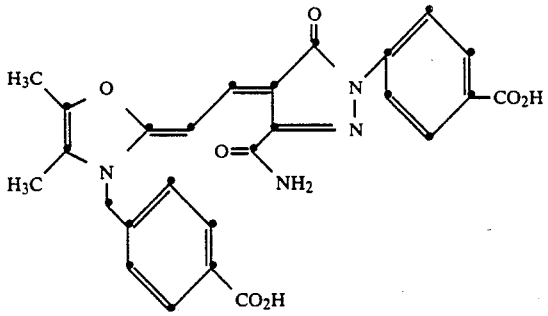
(96)
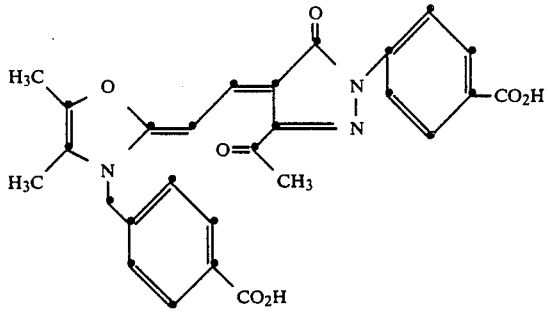
(97)
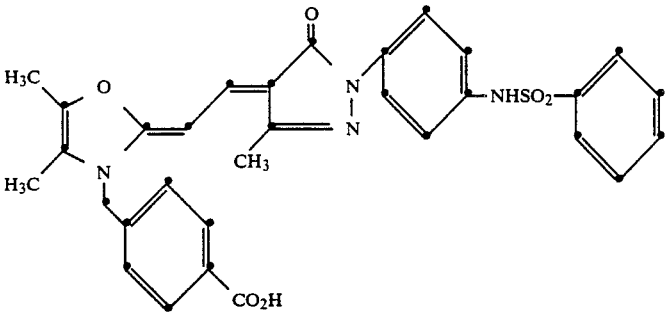

-continued
General Structure:
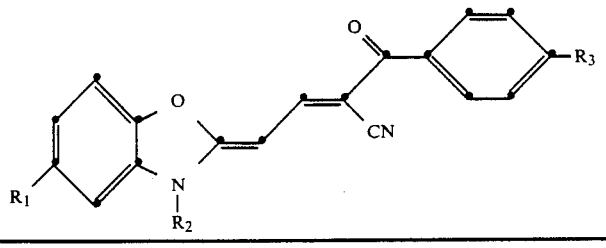
(98)
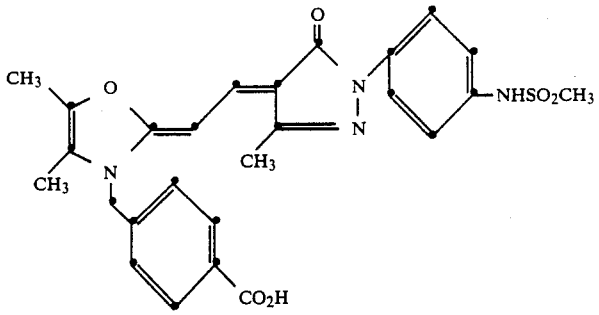
(99)
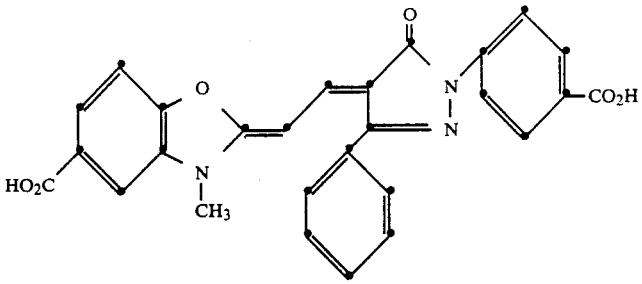
(100)
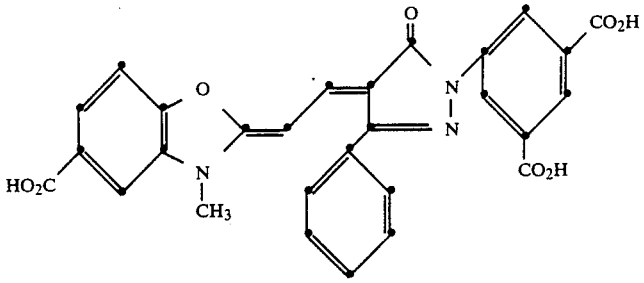
(101)
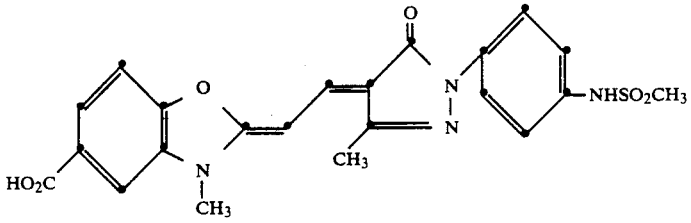
(102)
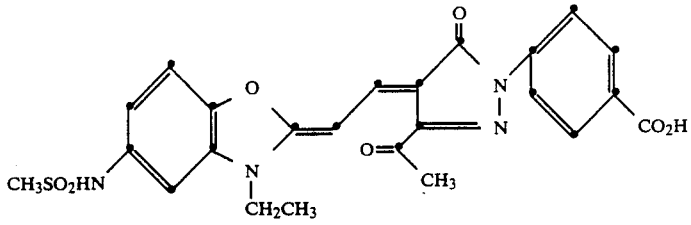

-continued
General Structure:
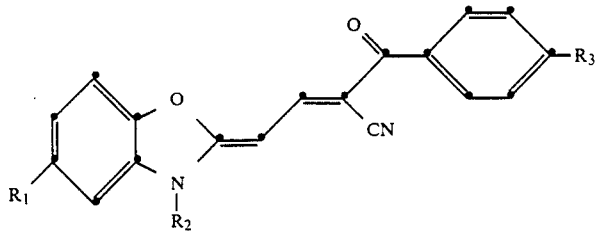
(103)
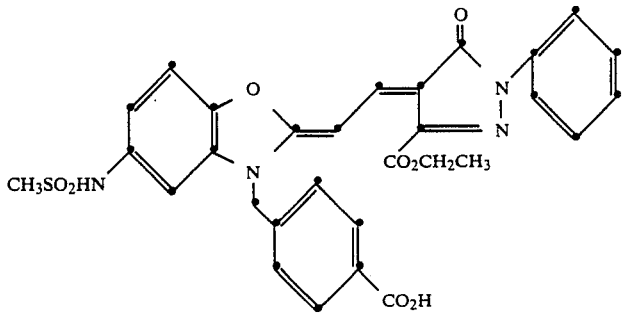
(104)
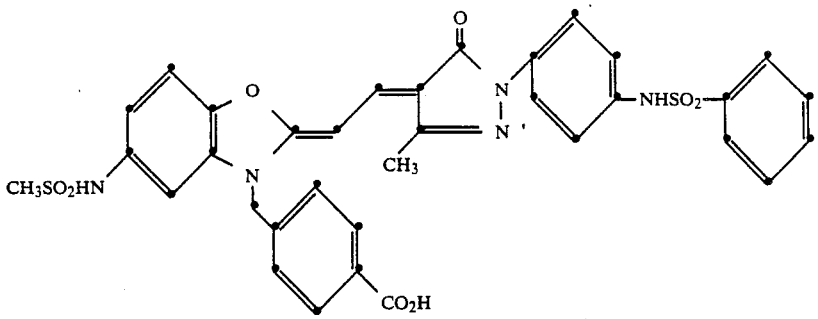
(105)
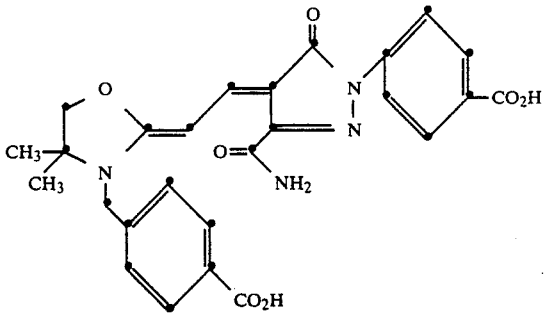
(106)
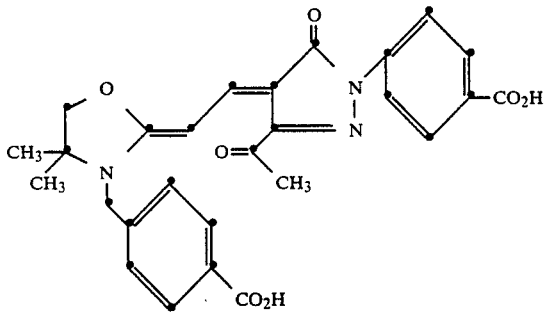

-continued
General Structure:
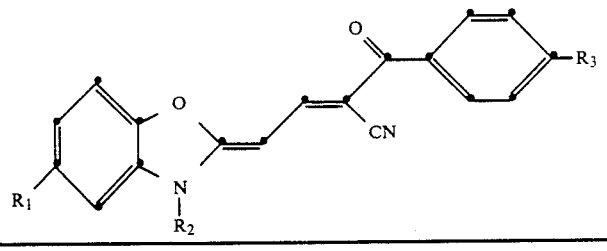
(107)
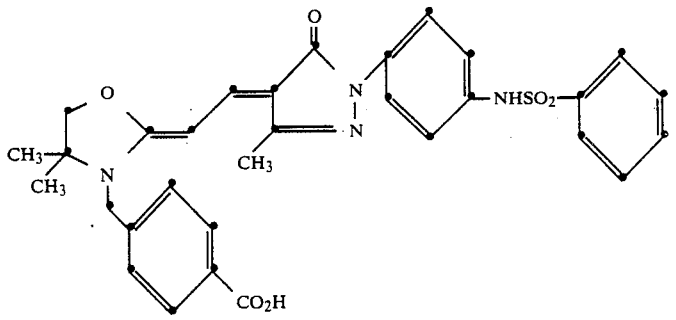
(108)
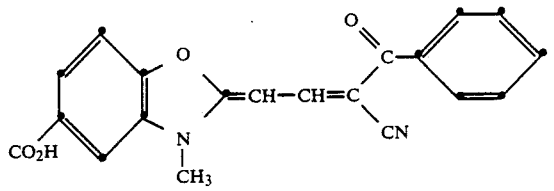
(109)
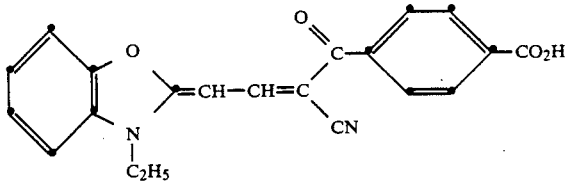
(110)
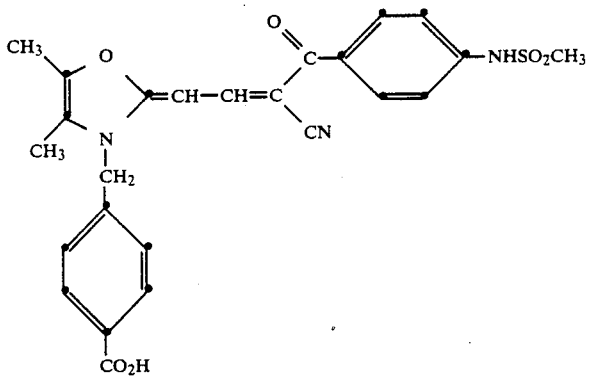

-continued
General Structure:
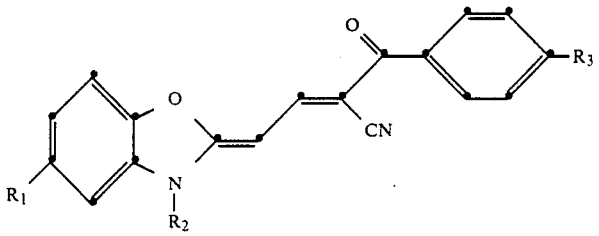
(111)
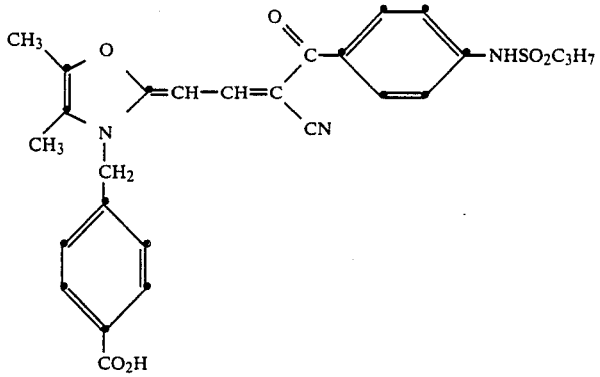
(112)
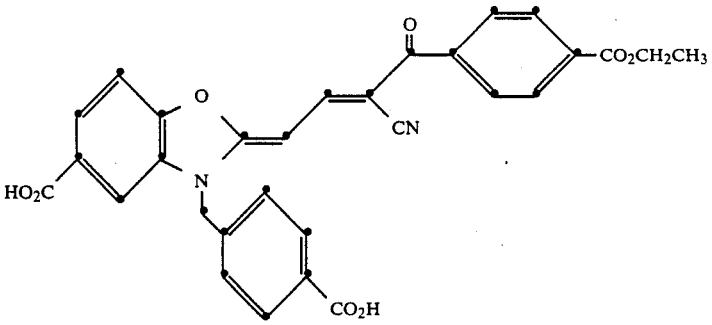
(113)
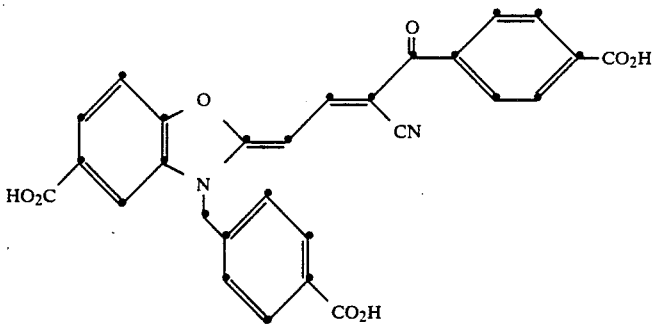
(114)
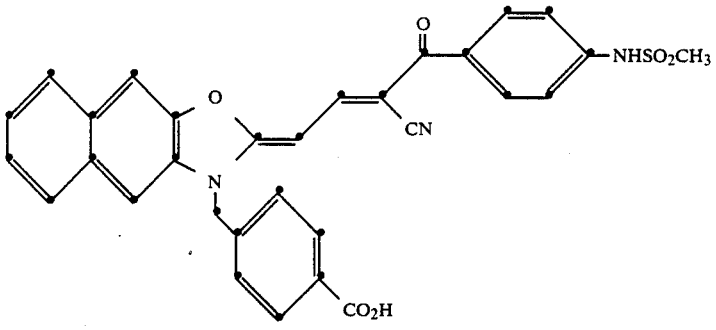

-continued
General Structure:
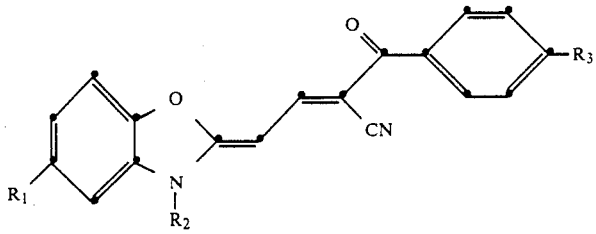
(115)
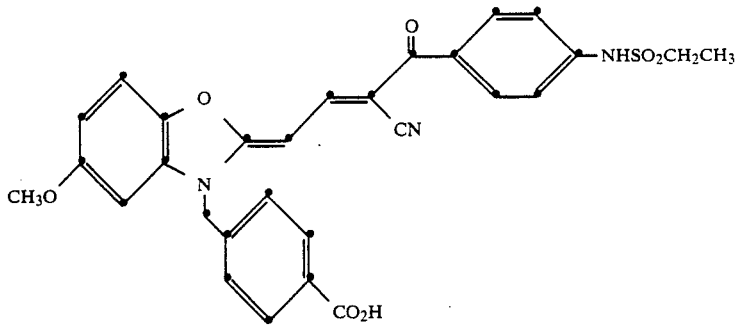
(116)
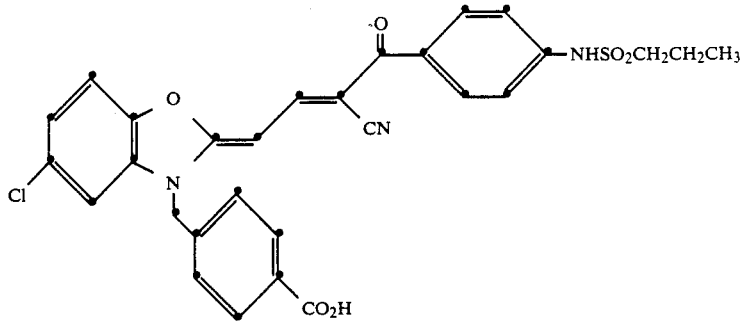
(117)
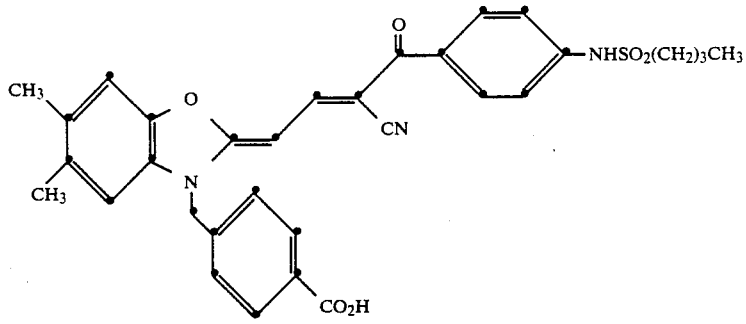
(118)
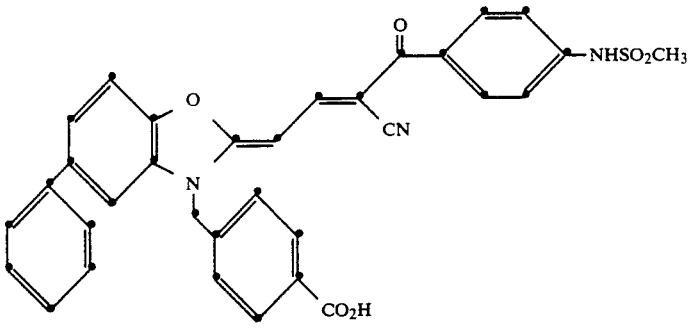

-continued
General Structure:
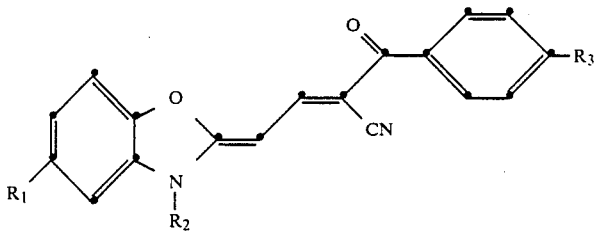
(119)
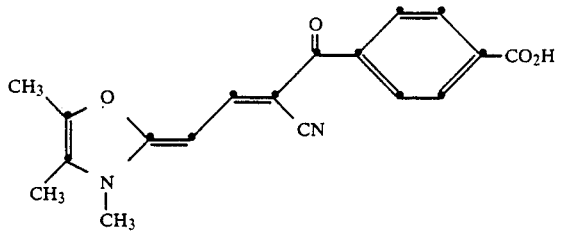
(120)
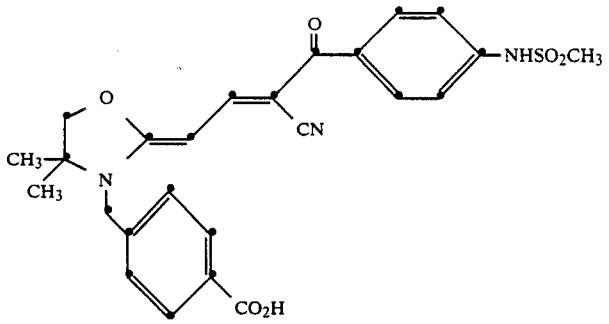
(121)
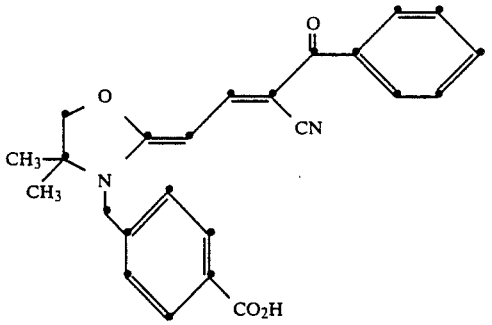
(122)
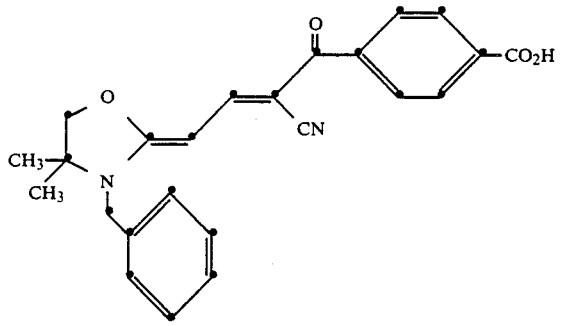

-continued
General Structure:
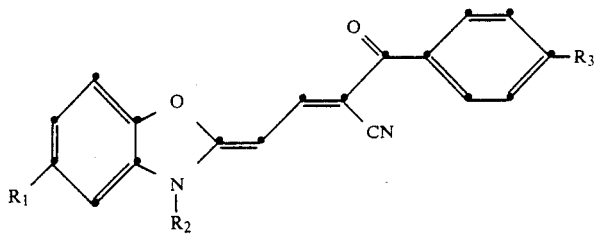
(123)
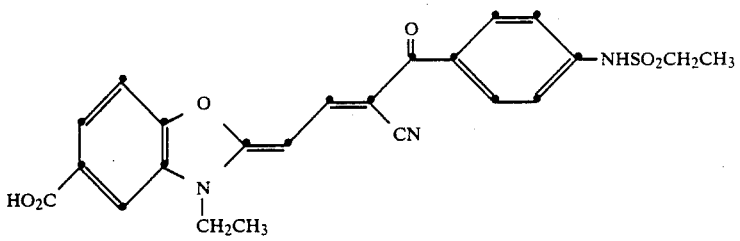
(124)
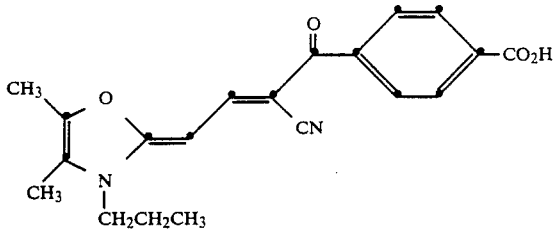
(125)
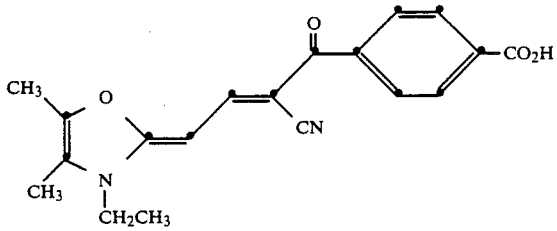
(126)
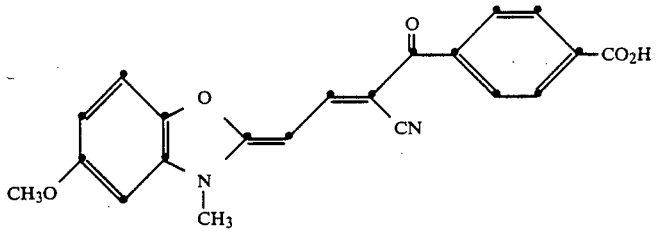
(127)
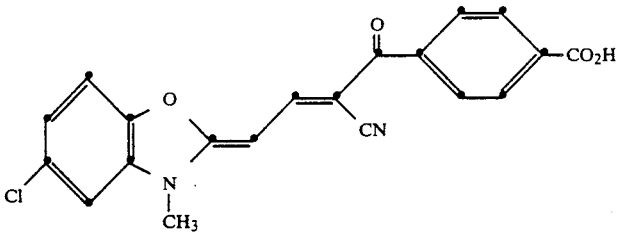

-continued
General Structure:
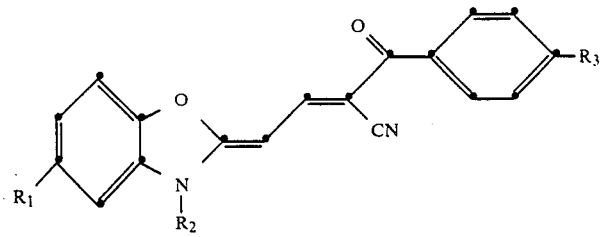
(128)
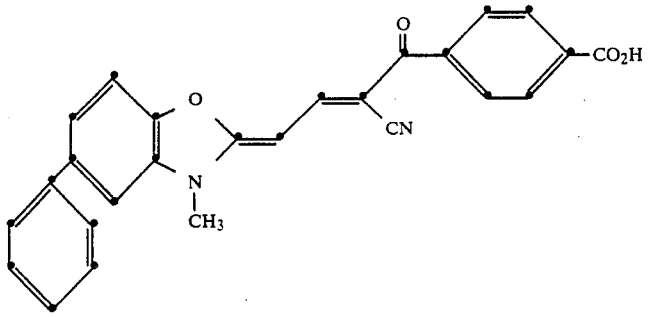
(129)
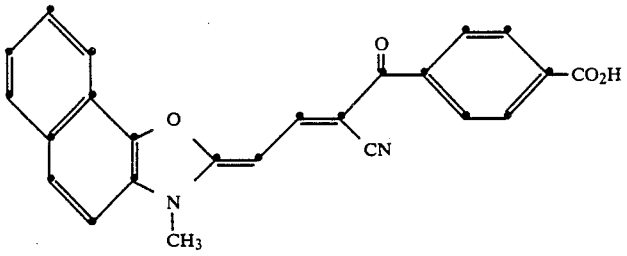
(130)
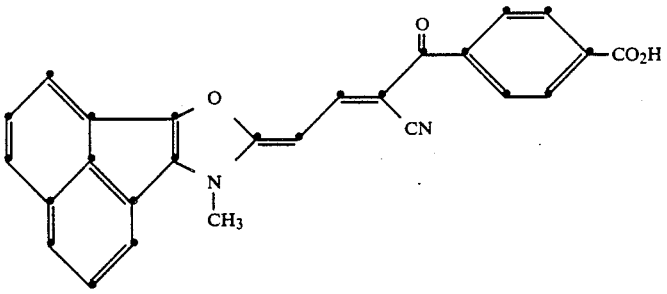
(131)
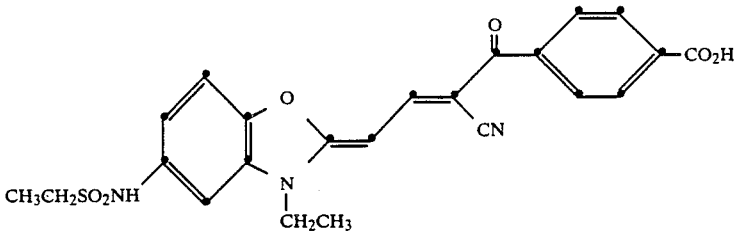

-continued
General Structure:
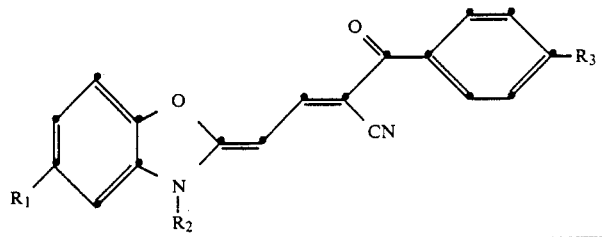
(132)
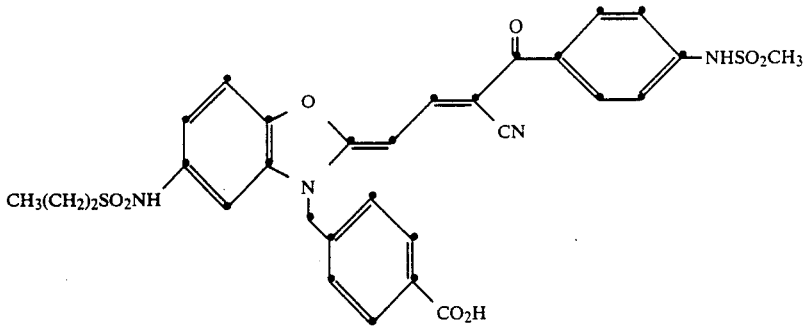
Examples of dyes according to formula (IX) include:
(4)
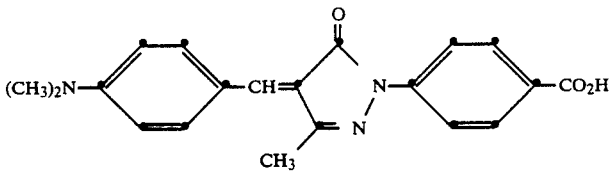
(1)
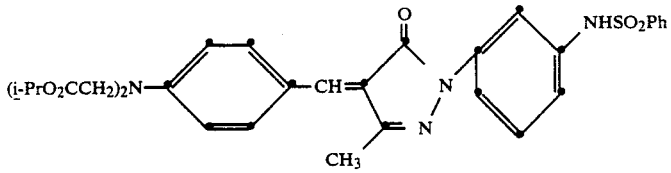
(47)
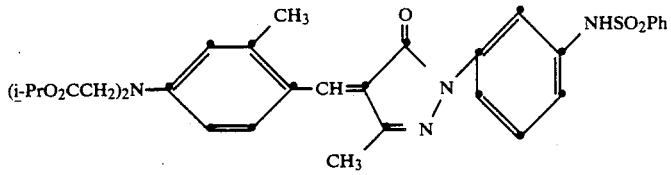
(48)
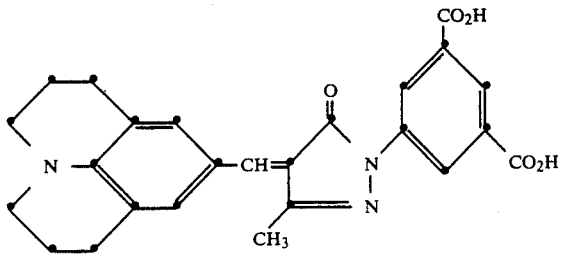
(14)
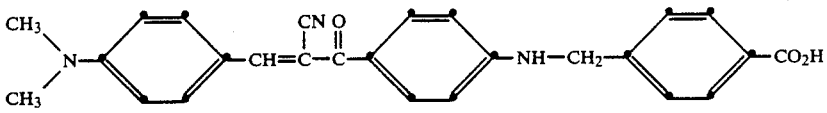

General Structure:

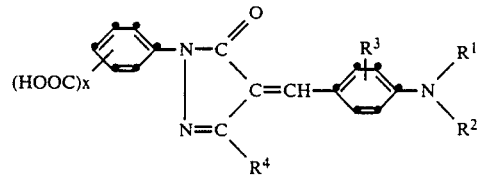

| Dye | $R^1$, $R^2$ | $R^3$ | $R^4$ | 1-Ph Substn. x Position |
|---|---|---|---|---|
| 139 | $C_2H_5$ | H | $CH_3$ | 1 4 |
| 140 | n-$C_4H_9$ | H | $CH_3$ | 1 4 |
| 3 | $CH_3$ | H | $COOC_2H_5$ | 1 4 |
| 142 | i-$C_3H_7OCCH_2$ ‖ O | $CH_3$ | $CH_3$ | 1 4 |
| 143 | $CH_3$ | H | $CH_3$ | 2 3,5 |
| 144 | $C_2H_5$ | H | $CH_3$ | 2 3,5 |
| 145 | n-$C_4H_9$ | H | $CH_3$ | 2 3,5 |
| 146 | i-$C_3H_7OCCH_2$ ‖ O | H | $CH_3$ | 2 3,5 |
| 147 | i-$C_3H_7OCCH_2$ ‖ O | $CH_3$ | $CH_3$ | 2 3,5 |
| 148 | i-$C_3H_7OCCH_2$ | H | $CH_3$ | 1 4 |
| 149 | $CH_3$ | H | COOEt | 1 3,5 |
| 150 | $C_2H_5$ | H | COOEt | 1 4 |
| 151 | $CH_3$ | H | $CF_3$ | 1 4 |
| 152 | $CH_3$ | H | Ph | 1 4 |
| 153 | $CH_3$ | H | O ‖ $CCH_3$ | 1 4 |

The dyes of formula (I) can be prepared by synthetic techniques well known in the art. Such techniques are further illustrated, for example, in "*The Dyanine Dyes and Related Compounds*", Frances Hamer, Interscience Publishers, 1964.

The dye compounds of formula (I) are utilized in the form of a solid particle dispersion (i.e., the dye is in the form of solid particles of microscopic size). The dispersion can be in any vehicle in which the dye is not soluble, such as an aqueous liquid having a pH low enough for the dye to be insoluble (e.g., a gelatin coating solution), an organic solvent in which the dye is insoluble, a monomer, or a polymeric binder. The dispersion is useful for incorporation into a layer having a polymeric film-forming binder known in the art (e.g., a hydrophilic colloid binder) a photographic element.

The dyes may be located in any layer of the element where it will be between the radiation sensitive layer and the first radiation source. Examples of such layer arrangements include:

| |
|---|
| Filter Dye Layer<br>Radiation-Sensitive Layer<br>Opaque Support |
| Filter Dye Layer<br>Radiation-Sensitive Layer<br>Transparent Support<br>Opaque Pelloid Layer |
| Filter Dye Layer<br>Radiation-Sensitive Layer<br>Transparent Support<br>Filter Dye Layer |
| Filter Dye Layer<br>Radiation-Sensitive Layer<br>Filter Dye Layer<br>Transparent Support |

Of course, the above examples of layer arrangements are intended to show the relative positions of the support, radiation sensitive layer, and filter dye layers in elements used according to the invention. Other layers may, such as antihalation layers, interlayers, protective overcoat layers, subbing layers, and the like may be included anywhere that they are useful in the above exemplified layer arrangements without disturbing the relative positions of the layers shown.

The dye should be present in an amount sufficient to prevent formation in the radiation sensitive layer of a developable latent image from exposure to the first radiation source. The formation of a latent image is described in James, *The Theory of the Photographic Process*, 4th ed , ch. 6, Macmillan Publishing Co, 1977. The dye is preferably present in an amount sufficient so that the maximum density of the dye in the wavelength region emitted by the first source and to which the radiation sensitive layer is sensitive is at least 0.3. This optical density will generally be less than 10 density units for most photographic applications. Useful amounts of dye in the present in the filter dye layers of the element useful in the practice of the invention range from 0.1 to 100 mg/ft$^2$.

The solid particle dispersion can be formed by precipitating or by reprecipitating the dye in the form of a dispersion and/or by well-known milling techniques, e.g , ball-milling, sand-milling, or colloid-milling the solid dye in the presence of a dispersing agent. Reprecipitating techniques by dissolving the dye and precipitating by changing the solvent and/or the pH of the solution in the presence of a surfactant are well known in the art. Milling techniques are well known in the art and are described, for example in U.S. Pat. No. 4,006,025. The dye particles in the dispersion should have a mean diameter of less than 10 μm and preferably less than 1 μm. The dye particles can be conveniently prepared in sizes ranging down to about 0.01 μm or less.

The radiation-sensitive layer of the element useful in the practice of the invention can contain any of the known radiation-sensitive materials, such as silver halide, diazo image-forming systems, light-sensitive tellurium-containing compounds, light sensitive cobalt-containing compounds, and others described in, for example, J. Kosar, Light Sensitive Systems: Chemistry and Application of Nonsilver Halide Photographic Processes, J. Wiley & Sons, N.Y. (1965).

Silver halide is especially preferred as a radiation sensitive material. Silver halide emulsions can contain, for example, silver bromide, silver chloride, silver iodide, silver chlorobromide, silver chloroiodide, silver bromoiodide, or mixtures thereof. The emulsions can include coarse, medium, or fine silver halide grains bounded by 100, 111, or 110 crystal planes. Silver halide emulsions and their preparation are further described in *Research Disclosure*, Section I. Also useful are tabular grain silver halide emulsions, as described in *Research Disclosure*, January, 1983, Item 22534 and U.S Pat. No. 4,425,426.

The radiation-sensitive materials described above can be sensitized to the desired wavelength range of radiation, such as the red, blue, or green portions of the visible spectrum, or to other wavelength ranges, such as ultraviolet, infrared, X-ray, and the like. Sensitization of silver halide can be accomplished with chemical sensitizers such as gold compounds, iridium compounds, or other group VIII metal compounds, or with spectral sensitizing dyes such as cyanine dyes, merocyanine dyes, styryls, or other known spectral sensitizers. Additional information on sensitization of silver halide is described in *Research Disclosure,* Sections I–IV.

The element useful in the practice of the invention can advantageously utilize radiation sensitive silver halide materials that include low intensity reciprocity failure inducers to enhance white-light handleability, as described in U.S. Pat. No.4,472,497.

The support of the element useful in the practice of the invention can be any of a number of well-known supports for photographic elements. These include polymeric films such as cellulose esters (e.g., cellulose triacetate and diacetate) and polyesters of dibasic aromatic carboxylic acids with divalent alcohols (e.g., poly(ethylene terephthalate)), paper, and polymer-coated paper. Such supports are described in further in *Research Disclosure,* December, 1978, Item 17643 [hereinafter referred to as *Research Disclosure*], Section XVII.

The element useful in the practice of the invention can also include any of a number of other well-known additives and layers, as described in *Research Disclosure.* These include, for example, optical brighteners, antifoggants, image stabilizers, light absorbing materials such as filter layers or intergrain absorbers, light-scattering materials, gelatin hardeners, coating aids and various surfactants, overcoat layers, interlayers and barrier layers, antistatic layers, plasticizers and lubricants, matting agents, development inhibitor-releasing couplers, bleach accelerator-releasing couplers, and other additives and layers known in the art.

The layer containing the dye of formula (I) can be located in various locations of the photographic element, as described above. In a preferred embodiment, the dye is preferably located in a layer where it will be subjected to high pH (i.e., 8 to 12) and/or sulfite during photographic processing, so as to allow the dye to be solubilized and removed or decolorized.

The photographic elements useful in the practice of the invention, when exposed, can be processed to yield an image. During processing, the dye of formula (I) will generally be decolorized and/or removed. Following processing, the dye useful in the practice of the invention should contribute less than 0.10 density unit, and preferably less than 0.02 density unit to the transmission D-max in the visible region in the minimum density areas of the exposed and processed element.

Processing can be by any type of known photographic processing, as described in *Research Disclosure,* Sections XIX–XXIV, although it preferably includes a high pH (i.e., 8 or above) step utilizing an aqueous sulfite solution in order to maximize decolorization and removal of the dye. A negative image can be developed by color development with a chromogenic developing agent followed by bleaching and fixing. A positive image can be developed by first developing with a non-chromogenic developer, then uniformly fogging the element, and then developing with a chromogenic developer. If the material does not contain a color-forming coupler compound, dye images can be produced by incorporating a coupler in the developer solutions.

Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium of potassium salts of ferric ethylenediaminetetraacetic acid), water soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The invention is further illustrated by the following Examples:

EXAMPLE 1

A pelloid layer comprising 20 mg/ft$^2$ of a soluble green-absorbing filter dye having the formula:

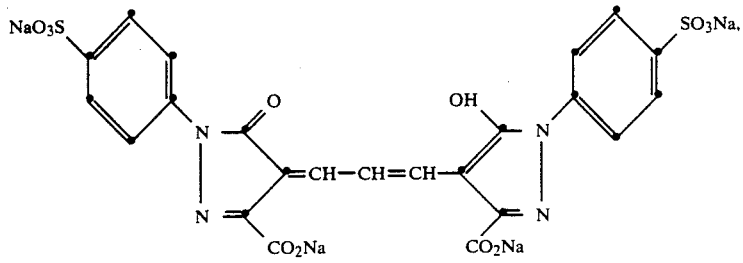

5 mg/ft$^2$ of a soluble infrared absorbing dye having the formula:

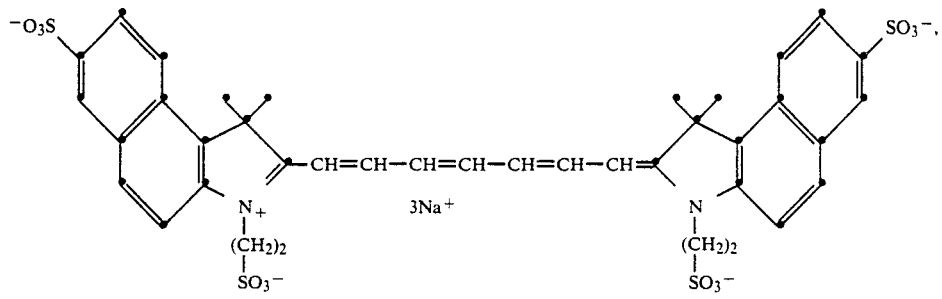

400 mg/ft$^2$ of gel, and 8 mg/ft$^2$ of bis(vinyl sulfone methyl ether) (BVSME) hardener was coated on a poly(ethylene terephthalate) film support.

An emulsion was prepared and coated on the opposite side of the support from the pelloid layer. The emulsion contained a 0.27 micron rhodium doped cubic $AgCl_{70}Br_{30}$ emulsion that was sulfur plus gold sensitized and doctored with 500 mg/mole Ag of 4,4'bis[(4,6-bis-o-chloroanilino-s-triazine-2-yl)-amino]-2,2'stilbene disulfonic acid disodium salt, and spectrally sensitized to infrared radiation with 0.03 millimoles/-mole Ag of a dye of the formula:

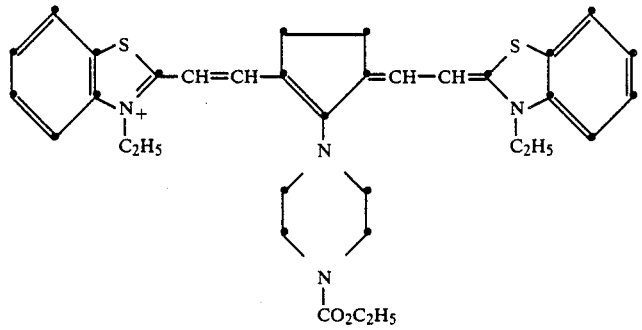

Other components of the emulsion were 100 mg/mole Ag of 1-(3-acetamidophenyl)-5-mercaptotetrazole and 1000 mg/mole Ag of 5-carboxy-4-hydroxy-6-methyl-2-methylmercapto-1,3,3*a*,7-tetraazindene. This emulsion was coated at a silver coverage level of 400 mg/ft$^2$ and a gel coverage of 400 mg/ft$^2$. The emulsion layer was overcoated with a solid particle dispersion filter dye layer adJusted to a pH of 5.2 containing a solid particle dispersion having a mean particle size of about 0.5 μm of dye 16 at a level of 10 mg/ft$^2$. This dye absorbs from about 450 nm to a sharp cutoff at about 590 nm. The filter dye layer also contained 0.7 mg/ft$^2$ of a soluble infrared absorbing dye of the formula:

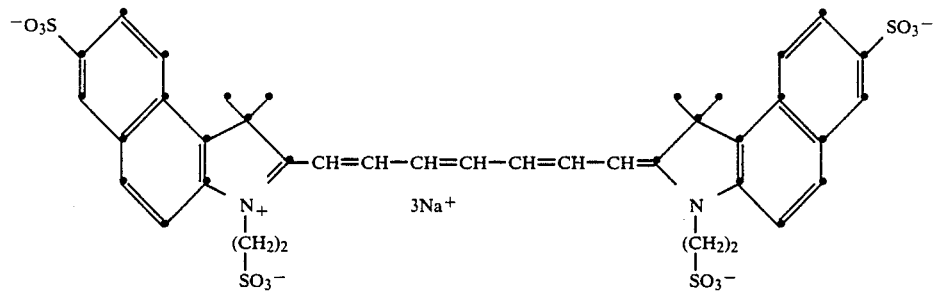

as a sharpness-improving intergrain absorber dye.

As a comparison, a similar element was prepared in which the pelloid layer was replaced by black adhesive polyester film tape #850 sold by 3M and the dispersion of dye 16 in the overcoat was omitted. The black film acted as a panchromatic pelloid layer, effectively replicating the pelloid layer of the element used according to the practice of the invention.

A green light source was constructed by wrapping sheets of dye coatings around a 4 ft. cool white fluorescent lamp. The dye coatings had optical densities of greater than 3 at wavelengths below 500 nm and between 580 nm and 860 nm. The minimum density of 1.8 was at a wavelength of 540 nm.

These 2 elements were exposed to this light source for 5 minutes against a white background in a fogging test and identical elements were also imagewise exposed to infrared radiation using a $10^{-3}$ second xenon flash exposure modulated by 1.0 inconel, Wratten 89B and 0.15 logE silver step tablet filters.

The elements were then developed for 30 seconds at 105° F. in a developer containing hydroquinone and sulfite and having a pH of 10.35. The densities recorded were measured with a densitometer.

The log speed to infrared at a D-min+1.0 was 1.38 for the comparison element and 1.41 for the element used according to the invention, indicating no desensitization from any dye wandering of the solid particle dispersion filter dye.

The observed neutral density from the fogging test was 1.03 for the comparison element whereas the element used according to the invention showed no measurable fog over the 0.05 background D-min of the element. Most of the solid particle dispersion filter dye was removed or decolorized during processing, leaving a D-min to green light of 0.10 as compared to 0.10 for the undyed comparison element. Thus, the element used according to the invention provided effective safelight handleability, with good dye washout and no adverse effects from the solid particle dispersion filter dye from dye wandering.

EXAMPLES 2-5

A series of elements were prepared by coating a poly(ethylene terephthalate) support with an emulsion as in Example 1, except the sensitizing dye had the formula:

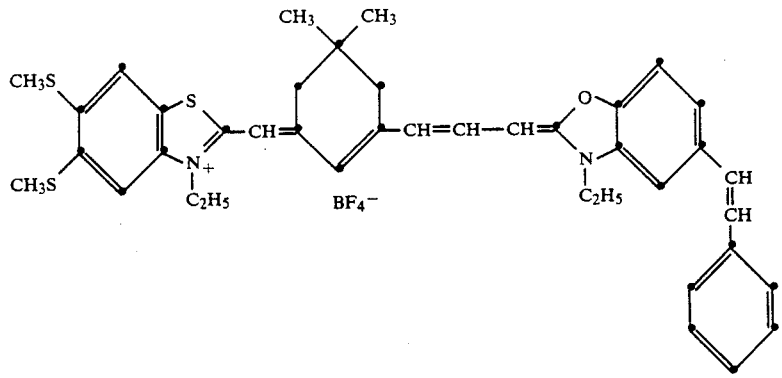

and the 5-carboxy-4-hydroxy-6-methyl-2-methylmercapto-1,3,3*a*, 7-tetraazaindene was coated at a level of 500 mg/mole Ag. The emulsion layer was overcoated with with 80 mg/ft$^2$ of gel to which had been added 4.8 mg/ft$^2$ of BVSME.

Another series of supports was then coated with various solid particle filter dye dispersions as described in Example 1. The dyes are indicated in Table I below. The dispersions were coated at a gelatin level of 150 mg/ft$^2$ of gel, a pH of 5.2, and BVSME at 1.5 mg/ft$^2$.

Each emulsion carrying support was sandwiched with a filter dye carrying support and exposed to the fogging test, processed, and evaluated as described in Example 1. For comparison, a Wratten 89B filter was used instead a filter dye-carrying support. The results are presented below in Table I.

TABLE I

| Example | Filter Dye | Fog Density |
|---|---|---|
| Control (unexposed) | none | 0.08 |
| Control | none | 1.72 |
| 2 | 3 | 0.70 |
| 3 | 4 | 1.11 |
| 4 | 15 | 0.11 |
| 5 | 16 | 0.07 |
| Comparison | Wratten 89B filter | 0.06 |

The results in Table I show that the solid particle filter dispersions significantly reduced the fog compared to the undyed control.

The invention has been described in detail with particular reference to preferred embodiments thereof, but it will be understood that variations and modifications can be effected within the spirit and scope of the invention.

What is claimed is:

1. A method of forming an image in a photographic element comprising handling the element under a first radiation source and imagewise exposing the element to a second radiation source, said element comprising a support having thereon a radiation-sensitive silver halide emulsion layer that is sensitive to at least a portion of the region of the spectrum of radiation emitted by the first radiation source and a portion of the region of the spectrum of radiation emitted by the second radiation source, and a layer, positioned in said element so as to be between the first radiation source and the radiation-sensitive layer during said handling step, comprising a hydrophilic binder and at least one filter dye that absorbs in the wavelength region emitted by the first source and to which the radiation-sensitive layer is sensitive, wherein said filter dye is a solid particle dispersion, having a mean diameter of from about 0.01 to 10 μm, in an amount sufficient to prevent formation in the radiation-sensitive layer of a developable latent image from exposure to the first radiation source, of a dye having the formula:

$$[D-(A)_y]-X_n \quad (I)$$

where D is a chromophoric radiation-absorbing moiety, said moiety comprising an aromatic ring when y is 0, A is an aromatic ring bonded directly or indirectly to D, X is a substituent, either on A or on an aromatic ring portion of D, with an ionizable proton having a pKa of 4 to 11 in a 50/50 mixture on a volume basis of ethanol and water, y is 0 to 4, and n is 1 to 7, said dye, when in nonionized form, having a log partition coefficient of from 0 to 6, except for dyes of the formula:

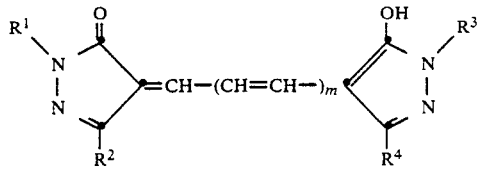

(II)

where $R^1$ and $R^3$ each independently represents an alkyl group or an aryl group, $R^2$ and $R^4$ each independently represents an alkyl group, an aryl group, or COOR where R is alkyl or aryl, m is 0 or a positive integer, and the molecule contains at least two carboxyl groups in their free acid form and further contains no solubilizing groups.

2. A process according to claim 1 wherein the radiation-sensitive layer is sensitive to some radiation between 350 to 900 nm, the first source emits some radiation between 350 and 700 nm, and the second source emits some radiation between 700 nm and 900 nm.

3. A process according to claim 2 wherein the filter dye absorbs some radiation between 350 and 700 nm.

4. A process according to claim 3 wherein the filter dye comprises a solid particle dispersion of a dye according to the formula:

$$D_1—L_1=A_1 \quad (III)$$

and a solid particle dispersion of a dye according to the formula:

$$D_2—L_2=L_3—L_4=A_2 \quad (IV)$$

$D_1$— and $D_2$— are each independently selected from the group consisting of:

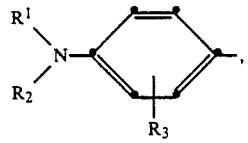

$A_3$-($L_5$=$L_6$)$_p$-, and

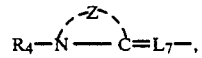

$A_1$, $A_2$, and $A_3$ are each independently a ketomethylene residue, $R_1$ and $R_2$ are each independently substituted or unsubstituted alkyl or substituted or unsubstituted aryl, or may represent the carbon atoms necessary to form a fused ring with the phenyl ring to which the N atom is attached, $R_3$ is hydrogen, substituted or unsubstituted alkyl, or substituted or unsubstituted aryl, $R_4$ is substituted or unsubstituted alkyl, $R_5$ is substituted or unsubstituted alkyl or substituted or unsubstituted aryl, $L_1$, $L_2$, $L_3$, $L_4$, $L_5$, $L_6$, and $L_7$ are each independently a substituted or unsubstituted methine group, Z represents the atoms necessary to complete a substituted or unsubstituted 5- or 6-membered heterocyclic nucleus, at least one of $A_1$, $A_2$, $A_3$, Z, and $R_4$ in the compound of formula (III) is substituted with —$X_1$ and at least one of $A_1$, $A_2$, $A_3$, Z, and $R_4$ in the compound of formula (IV) is substituted with —$X_2$, —$X_1$ and —$X_2$ are each independently —$CO_2H$ or —$NHSO_2R_5$, and p is 0 or 1.

5. A process according to claim 1 wherein the radiation sensitive layer is sensitive to some radiation between 350 to 700 nm, the first source emits some radiation between 560 and 700 nm, and the second source emits some radiation between 400 nm and 520 nm.

6. A process according to claim 5 wherein the filter dye absorbs some radiation between 540 and 700 nm.

7. A process according to claim 6 wherein the filter dye is represented by the formula:

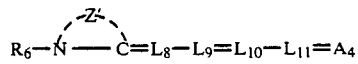

(V)

wherein $A_4$ is a ketomethylene residue, $L_8$, $L_9$, $L_{10}$, and $L_{11}$ are each independently a substituted or unsubstituted methine group, $R_6$ is substituted or unsubstituted alkyl, Z' represents the atoms necessary to complete a substituted or unsubstituted 5- or 6-membered heterocyclic nucleus, at least one of $A_4$, Z', and $R_6$ is substituted with —$X_4$, and —$X_4$ is —$CO_2H$ or —$NHSO_2R_7$, wherein $R_7$ is substituted or unsubstituted alkyl or substituted or unsubstituted aryl.

8. A process according to claim 1 wherein the radiation sensitive layer is sensitive to some radiation between 350 to 700 nm, the first source emits some radiation between 450 and 570 nm and the second source emits some radiation between 600 nm and 700 nm.

9. A process according to claim 8 wherein the filter dye absorbs some radiation between 450 and 590 nm.

10. A process according to claim 9 wherein the filter dye is selected from the group consisting of a compound of formula:

$$A_5—L_{12}=L_{13}—L_{14}=A_6 \quad (VI)$$

and a compound of formula:

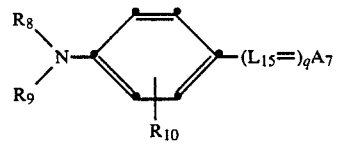

(VII)

wherein $A_5$, $A_6$, and $A_7$ are each independently a ketomethylene residue, $L_{12}$, $L_{13}$, $L_{14}$, and $L_{15}$ are each independently a substituted or unsubstituted methine group, $R_8$ and $R_9$ are each independently substituted or unsubstituted alkyl or substituted or unsubstituted aryl, or may represent the carbon atoms necessary to form a fused ring with the phenyl ring to which the N atom is attached, $R_{10}$ is hydrogen, substituted or unsubstituted alkyl, or substituted or unsubstituted aryl, at least one of $A_5$ and $A_6$ is substituted with —$X_5$ and at least one of $A_7$ and $R_9$ is substituted with —$X_7$, —$X_5$ and —$X_7$ are each independently —$CO_2H$ or —$NHSO_2R_{11}$, wherein $R_{11}$ is substituted or unsubstituted alkyl or substituted or unsubstituted aryl, and q is 1 or 3.

11. A process according to claim 1 wherein the radiation-sensitive layer is sensitive to some radiation between 350 to 600 nm, the first source emits some radiation between 400 and 510 nm, and the second source emits some radiation between 510 nm and 600 nm.

12. A process according to claim 11 wherein the filter dye absorbs some radiation between 380 and 500 nm.

13. A process according to claim 12 wherein the filter dye is selected from the group consisting of a compound of formula (VIII):

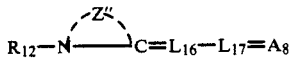

(VIII)

and a compound of formula:

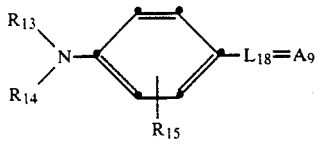

(IX)

wherein $A_8$ and $A_9$ are each independently a ketomethylene residue, $R_{12}$ is substituted or unsubstituted alkyl, $R_{13}$ and $R_{14}$ are each independently substituted or unsubstituted alkyl or substituted or unsubstituted aryl, or may form a carbocyclic ring fused with the phenyl ring to which the N atom is attached, $R_{15}$ is hydrogen, substituted or unsubstituted alkyl, or substituted or unsubstituted aryl, $L_{16}$, $L_{17}$, and $L_{18}$ are each independently a substituted or unsubstituted methine group, Z″ represents the atoms necessary to complete a substituted or unsubstituted 5- or 6-membered heterocyclic nucleus, at least one of $A_8$, Z″, and $R_{12}$ is substituted with —$X_8$ and at least one of $A_9$ and $R_{14}$ is substituted with —$X_9$, and —$X_8$ and —$X_9$ are each independently —$CO_2H$ or —$NHSO_2R_{16}$ wherein $R_{16}$ is substituted or unsubstituted alkyl or substituted or unsubstituted aryl.

14. A process according to claim 1 wherein said solid particle dispersion has a mean diameter of from about 0.01 to 1 μm.

* * * * *